US006068015A

United States Patent [19]

Pringle

[11] Patent Number: 6,068,015

[45] Date of Patent: May 30, 2000

[54] SIDEPOCKET MANDREL WITH ORIENTING FEATURE

[75] Inventor: Ronald E. Pringle, Houston, Tex.

[73] Assignee: Camco International Inc., Houston, Tex.

[21] Appl. No.: 09/244,804

[22] Filed: Feb. 5, 1999

Related U.S. Application Data

[63] Continuation-in-part of application No. 08/912,150, Aug. 15, 1997.

[60] Provisional application No. 60/023,965, Aug. 15, 1996, and provisional application No. 60/073,942, Feb. 6, 1998.

[51] Int. Cl.[7] ..... F04F 1/20

[52] U.S. Cl. ..... 137/155; 166/117.5

[58] Field of Search ..... 137/155; 166/117.5

[56] References Cited

U.S. PATENT DOCUMENTS

| | | |
|---|---|---|
| 2,668,554 | 2/1954 | Seyffert, Jr. . |
| 2,679,903 | 6/1954 | McGowen, Jr. et al. . |
| 3,280,914 | 10/1966 | Sizer et al. . |
| 3,889,748 | 6/1975 | Tausch . |
| 4,106,563 | 8/1978 | Gatlin et al. . |
| 4,239,082 | 12/1980 | Terral . |
| 4,480,686 | 11/1984 | Coussan . |
| 5,058,670 | 10/1991 | Crawford et al. . |
| 5,172,717 | 12/1992 | Boyle et al. . |
| 5,176,164 | 1/1993 | Boyle . |
| 5,469,878 | 11/1995 | Pringle . |
| 5,535,767 | 7/1996 | Schnatzmeyer et al. . |

FOREIGN PATENT DOCUMENTS

| | | |
|---|---|---|
| 2 289 296 | 11/1995 | United Kingdom . |

*Primary Examiner*—Gerald A. Michalsky
*Attorney, Agent, or Firm*—Tobor, Goldstein & Healey, LLP

[57] ABSTRACT

The present invention is an apparatus for orienting a first device in a first pocket in a mandrel relative to a second device in a second pocket in the mandrel, the first and second pockets being substantially parallel to one another, comprising: a first guide rail and a second guide rail, the first and second guide rails being on an inner surface of the mandrel and spaced apart in substantially parallel relationship to define a longitudinal groove therebetween; the first device having an orienting key and a first reference point, the orienting key and the first reference point being longitudinally aligned; the second device having a second reference point; and, the first and second reference points being longitudinally aligned when the orienting key is disposed within the longitudinal groove between the guide rails.

26 Claims, 32 Drawing Sheets

SIDEPOCKET MANDREL WITH ORIENTING FEATURE

RELATED APPLICATIONS

This is a continuation-in-part application of U.S. application Ser. No. 08/912,150, filed Aug. 15, 1997, which claims the benefit of U.S. Provisional Application No. 60/023,965, filed Aug. 15, 1996. This continuation-in-part application further claims the benefit of U.S. Provisional Application No. 60/073,942, filed Feb. 6, 1998.

BACKGROUND OF THE INVENTION

1. Field of the Invention

The present invention relates to subsurface well completion equipment and, more particularly, to an apparatus for lifting hydrocarbons from subterranean formations with gas at high production rates. Additionally, embodiments of independent and detachable actuators are disclosed.

2. Description of the Related Art

Artificial lift systems, long known by those skilled in the art of oil well production, are used to assist in the extraction of fluids from subterranean geological formations. The most ideal well for a company concerned with the production of oil, is one that flows naturally and without assistance. Often wells drilled in new fields have this advantage. In this ideal case, the pressure of the producing formation is greater than the hydrostatic pressure of the fluid in the wellbore, allowing the well to flow without artificial lift. However, as an oil bearing formation matures, and some significant percentage of the product is recovered, a reduction in the formation pressure occurs. With this reduction in formation pressure, the hydrocarbon issuance therefrom is likewise reduced to a point where the well no longer flows without assistance, despite the presence of significant volumes of valuable product still in place in the oil bearing stratum. In wells where this type of production decrease occurs, or if the formation pressure is low from the outset, artificial lift is commonly employed to enhance the recovery of oil from the formation. This disclosure is primarily concerned with one type of artificial lift called "Gas Lift."

Gas lift has long been known to those skilled in the art, as shown in U.S. Pat. No. 2,137,441 filed in November 1938. Other patents of some historic significance are U.S. Pat. Nos. 2,672,827, 2,679,827, 2,679,903, and 2,824,525, all commonly assigned hereto. Other, more recent developments in this field include U.S. Pat. Nos. 4,239,082, 4,360,064 of common assignment, as well as U.S. Pat. Nos. 4,295,796, 4,625,941, and 5,176,164. While these patents all contributed to furthering the art of gas lift valves in wells, recent trends in drilling and completion techniques expose and highlight long felt limitations with this matured technology.

The economic climate in the oil industry of the 1990's demands that oil producing companies produce more oil, that is now exponentially more difficult to exploit, in less time, and without increasing prices to the consumer. One successful technique that is currently being employed is deviated and horizontal drilling, which more efficiently drains hydrocarbon bearing formations. This increase in production makes it necessary to use much larger production tubing sizes. For example, in years past, 2⅜ inch production tubing was most common. Today, tubing sizes of offshore wells range from 4½ to 7 inches. While much more oil can be produced from tubing this large, conventional gas lift techniques have reached or exceeded their operational limit as a result.

In order for oil to be produced utilizing gas lift, a precise volume and velocity of the gas flowing upward through the tubing must be maintained. Gas injected into the hydrostatic column of fluid decreases the column's total density and pressure gradient, allowing the well to flow. As the tubing size increases, the volume of gas required to maintain the well in a flowing condition increases as the square of the increase in tubing diameter. If the volume of the gas lifting the oil is not maintained, the produced oil falls back down the tubing, and the well suffers a condition commonly known as "loading up." If the volume of gas is too great, the cost of compression and recovery of the lift gas becomes a significant percentage of the production cost. As a result, the size of a gas injection orifice in the gas lift valve is of crucial importance to the stable operation of the well. Prior art gas lift valves employ fixed diameter orifices in a range up to ¾ inch, which may be inadequate for optimal production in large diameter tubing. This size limitation is geometrically limited by the gas lift valve's requisite small size, and the position of its operating mechanism, which prevents a full bore through the valve for maximum flow.

Because well conditions and gas lift requirements change over time, those skilled in the art of well operations are also constantly aware of the compromise of well efficiency that must be balanced versus the cost of intervention to install the most optimal gas lift valves therein as well conditions change over time. Well intervention is expensive, most especially on prolific offshore or subsea wells, so a valve that can be utilized over the entire life of the well, and whose orifice size and subsequent flow rate can be adjusted to changing downhole conditions, is a long felt and unresolved need in the oil industry. There is also a need for a novel gas lift valve that has a gas injection orifice that is large enough to inject a volume of gas adequate to lift oil in large diameter production tubing. There is also a need for differing and novel operating mechanisms for gas lift valves that will not impede the flow of injection gas therethrough. Finally, there is a need for an approach to orienting a gas lift valve relative to a first side pocket within a mandrel into which the gas lift valve is remotely inserted and/or relative to a second pocket, within the same mandrel, that is parallel to the first side pocket.

SUMMARY OF THE INVENTION

The present invention has been contemplated to overcome the foregoing deficiencies and meet the above described needs. In one aspect, the present invention is a gas lift valve for use in a subterranean well, comprising: a valve body with a longitudinal bore therethrough for sealable insertion in a mandrel; a variable orifice valve in the body for controlling fluid flow into the body; and, an actuating means connected to the variable orifice valve. Another feature of this aspect of the present invention is that the actuating means may be electro-hydraulically operated, and may further include: a hydraulic pump located in a downhole housing; an electric motor connected to and driving the hydraulic pump upon receipt of a signal from a control panel; hydraulic circuitry connected to and responding to the action of the pump; and, a moveable hydraulic piston responding to the hydraulic circuitry and operatively connected to the variable orifice valve, controlling movement thereof. Another feature of this aspect of the present invention is that the actuating means may further include a position sensor to report relative location of the moveable hydraulic piston to the control panel. Another feature of this aspect of the present invention is that the actuating means may be selectively installed and retrievably detached from the gas lift valve.

Another feature of this aspect of the present invention is that the actuating means may further include at least one pressure transducer communicating with the hydraulic circuitry, and transmitting collected data to the control panel. Another feature of this aspect of the present invention is that the actuating means may further include a mechanical position holder. Another feature of this aspect of the present invention is that the actuating means may be selectively installed and retrievably detached from the gas lift valve.

Another feature of this aspect of the present invention is that the actuating means may be hydraulically operated, and may further include: a hydraulic actuating piston located in a downhole housing and operatively connected to the variable orifice valve; a spring, biasing the variable orifice valve in a full closed position; and, at least one control line connected to the hydraulic actuating piston and extending to a hydraulic pressure source. Another feature of this aspect of the present invention is that the actuating means may further include a position sensor to report relative location of the moveable hydraulic piston to a control panel. Another feature of this aspect of the present invention is that the actuating means may further include at least one pressure transducer communicating with the hydraulic actuating piston, and transmitting collected data to a control panel. Another feature of this aspect of the present invention is that the actuating means may be selectively installed and retrievably detached from the gas lift valve.

Another feature of this aspect of the present invention is that the actuating means may be electro-hydraulic, and may further include: at least one electrically piloted hydraulic solenoid valve located in a downhole housing; at least one hydraulic control line connected to the solenoid valve and extending to a hydraulic pressure source; hydraulic circuity connected to and responding to the action of the solenoid valve; and, a moveable hydraulic piston responding to the hydraulic circuitry and operatively connected to the variable orifice valve, controlling movement thereof. Another feature of this aspect of the present invention is that the actuating means may further include a position sensor to report relative location of the moveable hydraulic piston to a control panel. Another feature of this aspect of the present invention is that the actuating means may further include at least one pressure transducer communicating with the hydraulic circuitry, and transmitting collected data to a control panel. Another feature of this aspect of the present invention is that the actuating means may be selectively installed and retrievably detached from the gas lift valve.

Another feature of this aspect of the present invention is that the actuating means may be pneumo-hydraulically actuated, and may further include: a moveable hydraulic piston having a first and second end, operatively connected to the variable orifice valve, controlling movement thereof; at least one hydraulic control line connected to a hydraulic pressure source and communicating with the first end of the hydraulic piston; and, a gas chamber connected to and communicating with the second end of the hydraulic piston. Another feature of this aspect of the present invention is that the gas lift valve may be retrievably locatable within a side pocket mandrel by wireline and coiled tubing intervention tools. Another feature of this aspect of the present invention is that the gas lift valve may be selectively installed and retrievably detached from the actuating means. Another feature of this aspect of the present invention is that the actuating means may be selectively installed and retrievably detached from the gas lift valve.

In another aspect, the present invention may be a method of using a gas lift valve in a subterranean well, comprising: installing a first mandrel and a second mandrel in a well production string that are in operational communication; retrievably installing a variable orifice gas lift valve in a first mandrel; installing a controllable actuating means in a second mandrel; and, controlling the variable orifice gas lift valve by surface manipulation of a control panel that communicates with the actuating means. Another feature of this aspect of the present invention is that the method of installing the variable orifice gas lift valve and the actuating means may be by wireline intervention. Another feature of this aspect of the present invention is that the method of installing the variable orifice gas lift valve and the actuating means may be by coiled tubing intervention.

In another aspect, the present invention may be a gas lift valve for variably introducing injection gas into a subterranean well, comprising: a valve body with a longitudinal bore therethrough for sealable insertion in a mandrel; a variable orifice valve in the body for controlling flow of injection gas into the body; and, a moveable hydraulic piston connected to the variable orifice valve and in communication with a source of pressurized fluid; whereby the amount of injection gas introduced into the well through the variable orifice valve is controlled by varying the amount of pressurized fluid being applied to the moveable hydraulic piston. Another feature of this aspect of the present invention is that the source of pressurized fluid may be external to the gas lift valve and may be transmitted to the gas lift valve through a control line connected between the gas to lift valve and the external source of pressurized fluid. Another feature of this aspect of the present invention is that the external source of pressurized fluid may be located at the earth's surface. Another feature of this aspect of the present invention is that the source of pressurized fluid may be an on-board hydraulic system including: a hydraulic pump located in a downhole housing and in fluid communication with a fluid reservoir; an electric motor connected to and driving the hydraulic pump upon receipt of a signal from a control panel; and, hydraulic circuitry in fluid communication with the hydraulic pump and the hydraulic piston. Another feature of this aspect of the present invention is that the gas lift valve may further include an electrical conduit connecting the control panel to the gas lift valve for providing a signal to the electric motor. Another feature of this aspect of the present invention is that the hydraulic system may further include a solenoid valve located in the downhole housing and connected to the electrical conduit, the solenoid valve directing the pressurized fluid from the hydraulic system through the hydraulic circuitry to the hydraulic piston. Another feature of this aspect of the present invention is that the gas lift valve may further include at least one pressure transducer in fluid communication with the hydraulic circuitry and connected to the electrical conduit for providing a pressure reading to the control panel. Another feature of this aspect of the present invention is that the gas lift valve may further include an upstream pressure transducer connected to the electrical conduit and a downstream pressure transducer connected to the electrical conduit, the upstream and downstream pressure transducers being located within the gas lift valve to measure a pressure drop across the variable orifice valve, the pressure drop measurement being reported to the control panel through the electrical conduit. Another feature of this aspect of the present invention is that the gas lift valve may further include a position sensor to report relative location of the moveable hydraulic piston to the control panel. Another feature of this aspect of the present invention is that the gas lift valve may further include a mechanical position holder to mechanically assure that the variable orifice valve remains in its desired position if conditions in the hydraulic system change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the hydraulic system may further include a movable volume compensator piston for displacing a volume of fluid that is utilized as the hydraulic system operates. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further include a valve connection collet.

In another aspect, the present invention may be a gas lift valve for variably introducing injection gas into a subterranean well, comprising: a valve body with a longitudinal bore therethrough for sealable insertion in a mandrel; a hydraulic control line connected to the gas lift valve for providing a supply of pressurized fluid thereto; a variable orifice valve in the body for controlling flow of injection gas into the body; a spring biasing the variable orifice valve in a full closed position; a moveable hydraulic piston connected to the variable orifice valve; and, an actuating piston located in a downhole housing, connected to the moveable hydraulic piston and in communication with the control line; whereby the amount of injection gas introduced into the well through the variable orifice valve is controlled by varying the amount of pressurized fluid being applied to the actuating piston. Another feature of this aspect of the present invention is that the control line may be connected to a source of pressurized fluid located at the earth's surface. Another feature of this aspect of the present invention is that the gas lift valve may further include a mechanical position holder to mechanically assure that the variable orifice valve remains in its desired position if conditions in the gas lift valve change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further include a valve connection collet.

In another aspect, the present invention may be a gas lift valve for variably introducing injection gas into a subterranean well, comprising: a valve body with a longitudinal bore therethrough for sealable insertion in a mandrel; a valve-open and a valve-closed hydraulic control line connected to the gas lift valve for providing dual supplies of pressurized fluid thereto; a variable orifice valve in the body for controlling flow of injection gas into the body; and, a moveable hydraulic piston connected to the variable orifice valve and in fluid communication with the valve-open and valve-closed hydraulic control lines; whereby the variable orifice valve is opened by applying pressure to the hydraulic piston through the valve-open control line and bleeding off pressure from the valve-closed control line; the variable orifice valve is closed by applying pressure to the hydraulic piston through the valve-closed control line and bleeding off pressure from the valve-open control line; and, the amount of injection gas introduced into the well through the variable orifice valve is controlled by varying the amount of pressurized fluid being applied to and bled off from the hydraulic piston through the control lines. Another feature of this aspect of the present invention is that the control lines may be connected to a source of pressurized fluid located at the earth's surface. Another feature of this aspect of the present invention is that the gas lift valve may further include a mechanical position holder to mechanically assure that the variable orifice valve remains in its desired position if conditions in the gas lift valve change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further including a valve connection collet. Another feature of this aspect of the present invention is that the gas lift valve may further include a fluid displacement port for use during the bleeding off of pressurized fluid from the hydraulic piston. Another feature of this aspect of the present invention is that the gas lift valve may further include a valve-open and a valve-closed conduit for routing pressurized fluid from the valve-open and valve-closed control lines to the hydraulic piston.

Another feature of this aspect of the present invention is that the gas lift valve may further include an electrical conduit connecting a control panel at the earth's surface to the gas lift valve for communicating collected data to the control panel. Another feature of this aspect of the present invention is that the gas lift valve may further include a valve-open pressure transducer and to a valve-closed pressure transducer, the valve-open pressure transducer being connected to the electrical conduit and in fluid communication wit the valve-open conduit, the valve-closed pressure transducer being connected to the electrical conduit and in fluid communication with the valve-closed conduit, the pressure transducers providing pressure readings to the control panel via the electrical conduit. Another feature of this aspect of the present invention is that the gas lift valve may further include an upstream pressure transducer connected to the electrical conduit and a downstream pressure transducer connected to the electrical conduit, the upstream and downstream pressure transducers being located within the gas lift valve to measure a pressure drop across the variable orifice valve, the pressure drop measurement being reported to the control panel through the electrical conduit.

In another aspect, the present invention may be a gas lift valve for variably introducing injection gas into a subterranean well, comprising: a valve body with a longitudinal bore therethrough for sealable insertion in a mandrel; a hydraulic control line connected to the gas lift valve for providing a supply of pressurized fluid thereto; a variable orifice valve in the body for controlling flow of injection gas into the body; a nitrogen coil chamber providing a pressurized nitrogen charge through a pneumatic conduit for biasing the variable orifice valve in a full closed position; and, a moveable hydraulic piston connected to the variable orifice valve and in fluid communication with the hydraulic control line and the pneumatic conduit; whereby the variable orifice valve is opened by applying hydraulic pressure to the hydraulic piston through the hydraulic control line to overcome the pneumatic pressure in the pneumatic conduit; the variable orifice valve is closed by bleeding off pressure from the hydraulic control line to enable the pneumatic pressure in the nitrogen coil chamber to closed the variable orifice valve; and, the amount of injection gas introduced into the well through the variable orifice valve is controlled by varying the amount of hydraulic fluid being bled off from the hydraulic piston through the hydraulic control line. Another feature of this aspect of the present invention is that the hydraulic control line may be connected to a source of pressurized fluid located at the earth's surface. Another feature of this aspect of the present invention is that the gas lift valve may further include a mechanical position holder to mechanically assure that the variable orifice valve remains in its desired position if conditions in the gas lift valve change during use. Another feature of this aspect of the present invention is that the variable orifice valve may be stopped at intermediate positions between a full open and a full closed position to adjust the flow of injection gas therethrough, the variable orifice valve being held in the intermediate positions by the position holder. Another feature of this aspect of the present invention is that the variable orifice valve may further include a carbide stem and seat. Another feature of this aspect of the present invention is that the mandrel may be provided with at least one injection gas port through which injection gas flows when the variable orifice valve is open. Another feature of this aspect of the present invention is that the gas lift valve may further include an upper and lower one-way check valve located on opposite sides of the variable orifice valve to prevent any fluid flow from the well into the gas lift valve. Another feature of this aspect of the present invention is that the gas lift valve may further include latch means for adapting the variable orifice valve to be remotely deployed and retrieved. Another feature of this aspect of the present invention is that the variable orifice valve may be remotely deployed and retrieved by utilization of coiled tubing. Another feature of this aspect of the present invention is that the variable orifice valve may be remotely deployed and retrieved by utilization of wireline. Another feature of this aspect of the present invention is that the gas lift valve may further include a valve connection collet.

In another aspect, the present invention may be a gas lift valve for variably introducing injection gas into a subterranean well, comprising: a first mandrel connected to a second mandrel, the first and second mandrel being installed in a well production string; a valve means having a variable orifice for controlling flow of injection gas into the well, the valve means being installed in the first mandrel; an actuating means for controlling the valve means, the actuating means being installed in the second mandrel, in communication with and controllable from a control panel, and connected to the valve means by a first and second hydraulic control line. Another feature of this aspect of the present invention is that the valve means and the actuating means may be remotely deployed within and retrieved from their respective mandrels. Another feature of this aspect of the present invention is that the valve means and actuating means may be remotely deployed and retrieved by utilization of coiled tubing. Another feature of this aspect of the present invention is that the valve means and actuating means may be remotely deployed and retrieved by utilization of wireline.

In another aspect, the invention may be an apparatus for orienting a first device in a first pocket in a mandrel relative to a second device in a second pocket in the mandrel, the first and second pockets being substantially parallel to one another, comprising: a first guide rail and a second guide rail, the first and second guide rails being on an inner surface of the mandrel and spaced apart in substantially parallel relationship to define a longitudinal groove therebetween; the first device having an orienting key and a first reference point, the orienting key and the first reference point being longitudinally aligned; the second device having a second reference point; and the first and second reference points being longitudinally aligned when the orienting key is disposed within the longitudinal groove between the guide rails. Another feature of this aspect of the present invention is that the longitudinal groove is above the first pocket. Another feature of this aspect of the present invention is that the first and second guide rails are located within a discriminator trough in the mandrel. Another feature of this aspect of the present invention is that the first device is a latch attached to a variable orifice gas lift valve. Another feature of this aspect of the present invention is that the orienting key is attached to the latch. Another feature of this aspect of the present invention is that the first reference point is a latching dog on a collet finger, the collet finger being attached to a stem disposed for longitudinal movement within a valve body of the gas lift valve, the second reference point being a recess on the second device, the latching dog being securely engaged with the recess when the gas lift valve is in a lowermost position. Another feature of this aspect of the present invention is that the second device is a means for actuating the gas lift valve. Another feature of this aspect of the present invention is that the first pocket and the second pocket are connected by a window, and the connection between the latching dog and the recess is made through the window. Another feature of this aspect of the present invention is that the gas lift valve may include a first and a second flow window, and the mandrel may further include a first and a second flow port, the first flow port being aligned with the first flow window when the first and second reference points are longitudinally and elevationally aligned. Another feature of this aspect of the present invention is that the first and second flow windows are positioned at right angles to each other, and wherein the first and second flow ports are positioned at right angles to each other. Another feature of this aspect of the present invention is that the first device includes at least one additional reference point, and the second device includes at least one additional reference point, and the at least one additional reference point on the first device is aligned with the at least one additional reference point on the second device with the first and second reference points are longitudinally and elevationally aligned. Another feature of this aspect of the present invention is that the distance between the orienting key and the first reference point is such that the orienting key is disposed within the longitudinal groove between the guide rails when the first and second reference points are longitudinally and elevationally aligned.

In another aspect, the present invention may be an apparatus for orienting a variable orifice gas lift valve in a first pocket in a mandrel relative to a means for actuating the gas lift valve that is located in a second pocket in the mandrel, the first and second pockets being substantially parallel to one another, comprising: a first guide rail and a second guide rail, the first and second guide rails being on an inner surface of the mandrel and spaced apart in substantially parallel relationship to define a longitudinal groove therebetween; the gas lift valve having an orienting key and a latching dog, the orienting key and the latching dog being longitudinally aligned; the actuating means having a recess for engagably receiving the latching dog; and the latching dog and the actuator recess being longitudinally aligned when the orienting key is disposed within the longitudinal groove between the guide rails. Another feature of this aspect of the present invention is that the latching dog and the actuator recess are elevationally aligned and securely engaged when the gas lift valve is in a lowermost position. Another feature of this aspect of the present invention is that the first pocket and the second pocket are connected by a window, and the connection between the latching dog and to the recess is made through the window. Another feature of this aspect of the present invention is that the longitudinal groove is above the first pocket. Another feature of this aspect of the present invention is that the first and second guide rails are located within a discriminator trough in the mandrel. Another feature of this aspect of the present invention is that the orienting key is attached to a remotely retrievable latch, and the latch is attached to the gas lift valve. Another feature of this aspect of the present invention is that the latching dog is part of a collet finger, the collet finger being attached to a stem disposed for longitudinal movement within a valve body of the gas lift valve, the stem having an annular sealing surface, a first flow slot, and a second flow slot, the valve body having an annular stem seat, a first flow window, and a second flow window, the first and second flow windows and the first and second flow slots being longitudinally aligned, respectively, and being positioned relative to the latching dog so that when the latching dog is engaged with the actuator recess the first flow window and the first flow slot are longitudinally and elevationally aligned with a first flow port in the mandrel and the second flow window and the second flow slot are longitudinally and elevationally aligned with a second flow port in the mandrel. Another feature of this aspect of the present invention is that the first and second flow windows are positioned at right angles to each other, the first and second flow slots are positioned at right angles to each other, and the first and second flow ports are positioned at right angles to each other. Another feature of this aspect of the present invention is that the distance between the orienting key and the latching dog is such that the orienting key is disposed within the longitudinal groove between the guide rails when the latching dog and actuator recess are longitudinally and elevationally aligned. Another feature of this aspect of the present invention is that the first guide rail includes a first inclined surface extending away from the longitudinal groove and away from the first pocket, and the second guide rail further includes a second inclined surface extending away from the longitudinal groove and away from the first pocket. Another feature of this aspect of the present invention is that the actuating means is electro-hydraulically operated, further including: a hydraulic pump located in a downhole housing; an electric motor connected to and driving the hydraulic pump upon receipt of a signal from a control panel; hydraulic circuitry connected to and responding to the action of the pump; and a moveable hydraulic piston responding to the hydraulic circuitry and operatively connected to the variable orifice valve, controlling movement thereof. Another feature of this aspect of the present invention is that the actuating means is hydraulically operated, further including: a hydraulic actuating piston located in a downhole housing and operatively connected to the variable orifice valve; a spring, biasing the variable orifice valve in a full closed position; and at least one control line connected to the hydraulic actuating piston and extending to a hydraulic pressure source. Another feature of this aspect of the present invention is that the actuating means is electro-hydraulic further including: at least one electrically piloted hydraulic solenoid valve located in a downhole housing; at least one hydraulic control line connected to the solenoid valve and extending to a hydraulic pressure source; hydraulic circuity connected to and responding to the action of the solenoid valve; and a moveable hydraulic piston responding to the hydraulic circuitry and operatively connected to the variable orifice valve, controlling movement thereof. Another feature of this aspect of the present invention is that the actuating means is pneumo-hydraulically actuated, further comprising: a moveable hydraulic piston having a first and second end, operatively connected to the variable orifice valve, controlling movement thereof; at least one hydraulic control line connected to a hydraulic pressure source and communicating with the first end of the hydraulic piston; and a gas chamber connected to and communicating with the second end of the hydraulic to piston.

Figure 1A:
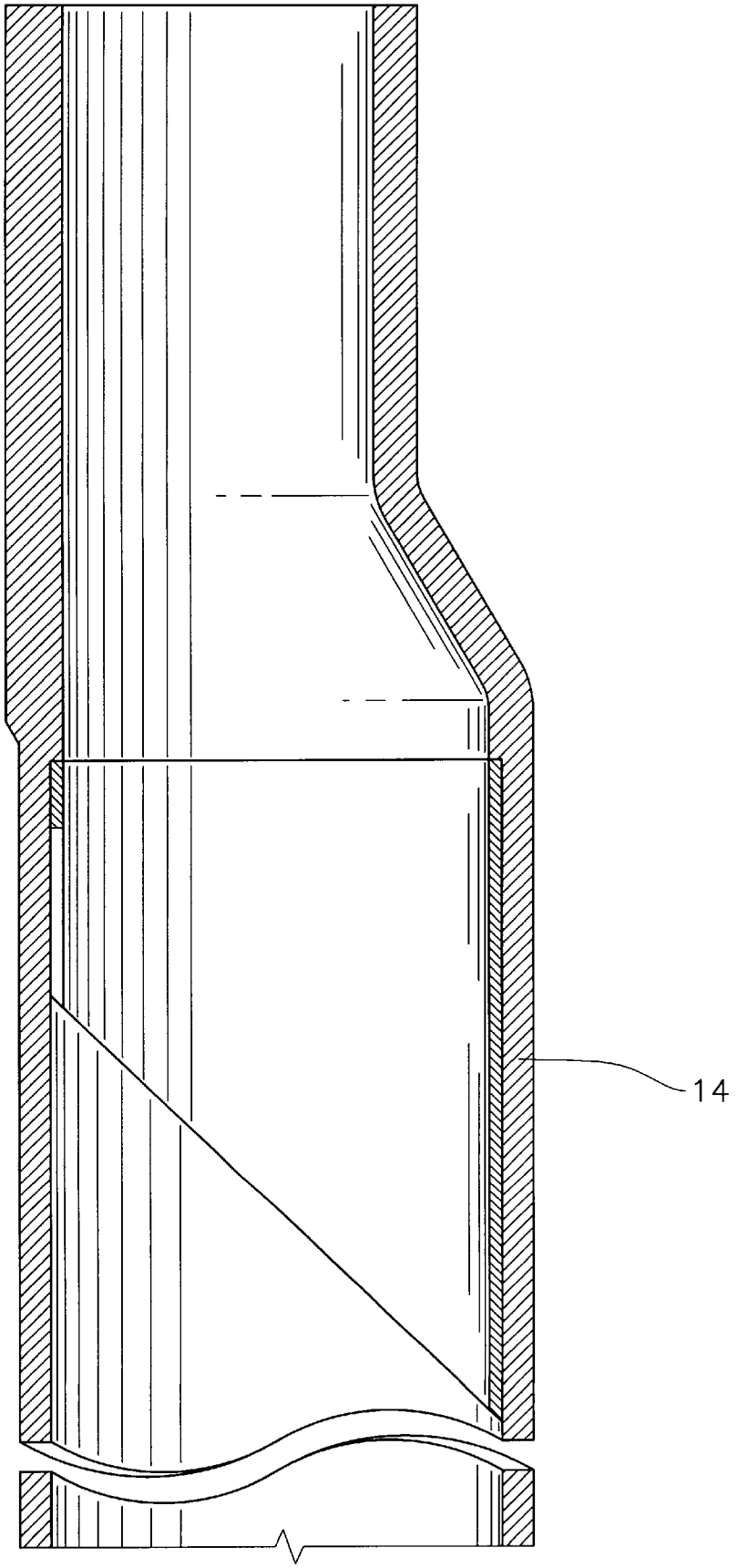
FIGS. 1A–1C are elevation views which together illustrate an electro-hydraulically operated embodiment of the apparatus of the present invention having an on-board hydraulic system and connected to an electrical conduit running from the earth's surface; the power unit is shown rotated ninety degrees for clarity.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DESCRIPTION OF THE PREFERRED EMBODIMENTS

In the description that follows, like parts are marked through the specification and drawings with the same reference numerals, respectively. The figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower," "up hole" and "downhole," and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

Figure 1B:
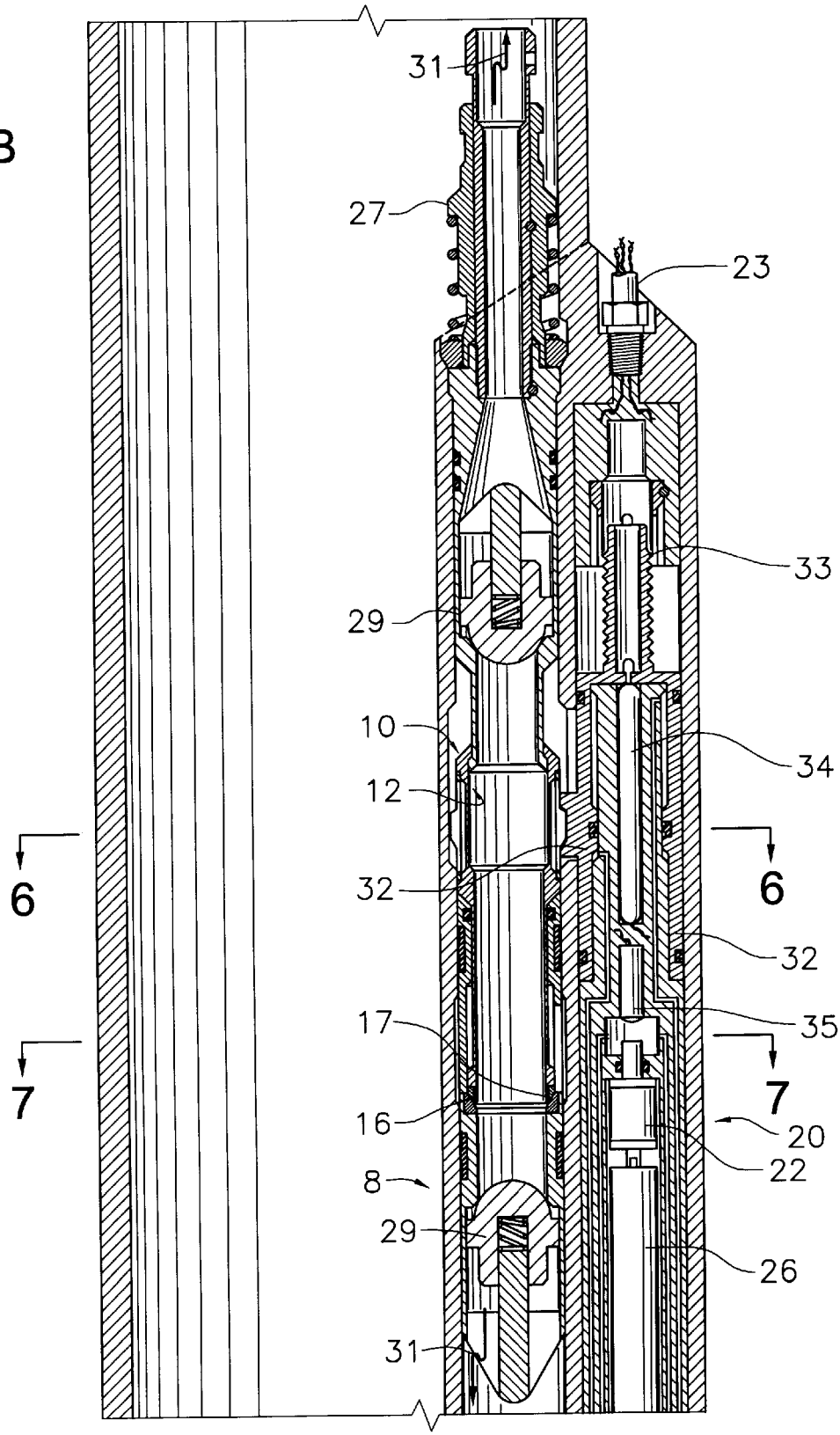
Figure 1C:
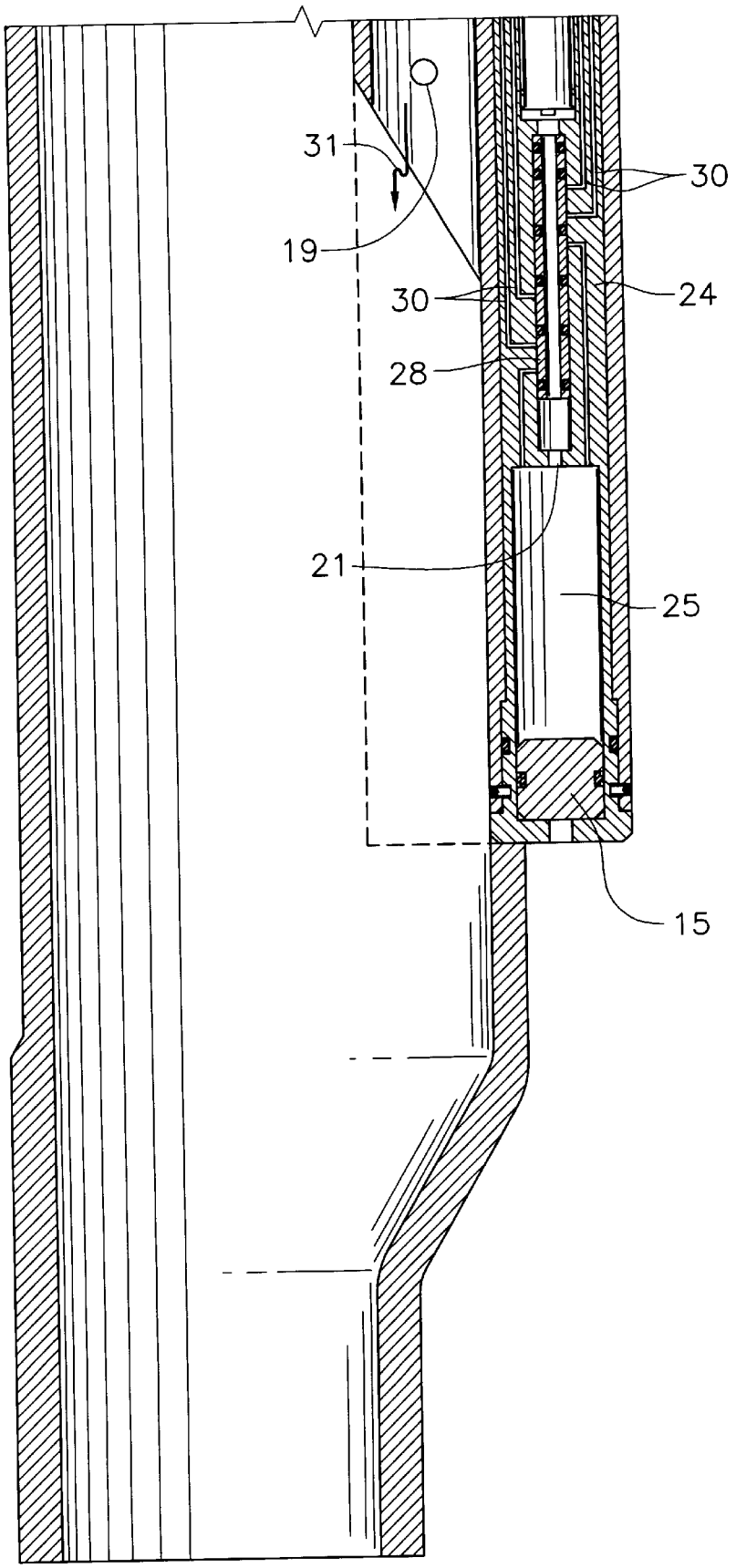
Figure 7:
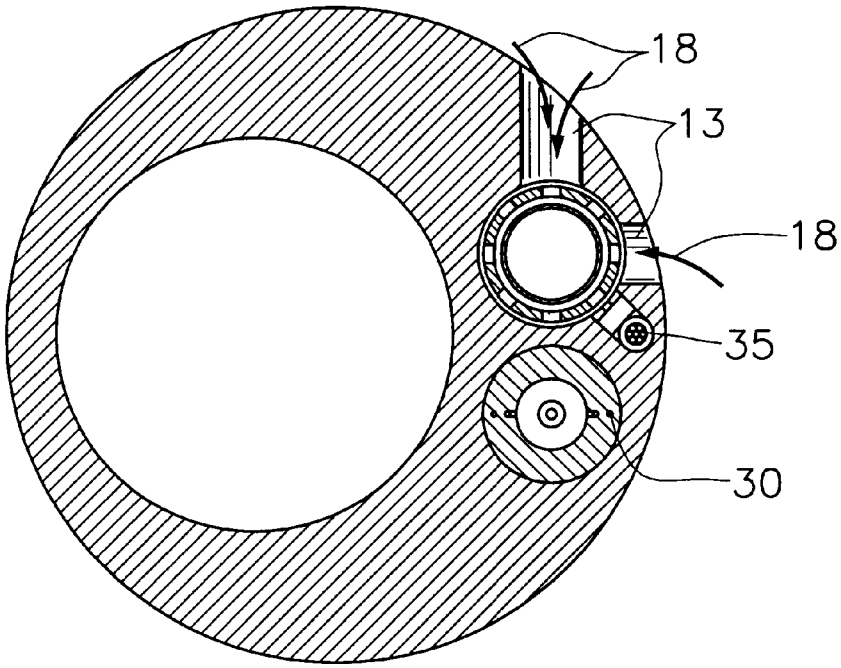
FIG. 7 is a cross-sectional view taken along line 7—7 of FIG. 1B.

FIGS. 1A–1C together show a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18 —see FIG. 7) into said body through injection gas ports 13 in the mandrel 14, and an actuating means, shown generally by numeral 20 which is electro-hydraulically operated using a hydraulic pump 22 located in a downhole housing 24, an electric motor 26 connected to and driving the hydraulic pump 22 upon receipt of a signal through an electrical conduit 23 connected to a control panel (not shown) located at the earth's surface. Also shown is a moveable temperature/volume compensator piston 15 for displacing a volume of fluid that is utilized as the actuating means 20 operates and for compensating for pressure changes caused by temperature fluctuations. A solenoid valve 28 controls the movement of pressurized fluid pumped from a control fluid reservoir 25 through a pump suction port 21 and in a hydraulic circuitry 30, and the direction of the fluid flowing therethrough, which is connected to and responding to the action of the pump 22. A moveable hydraulic piston 32 responding to the pressure signal from the hydraulic circuitry 30 opens and controls the movement of the variable orifice valve 16. The actuator has a position sensor 34 which reports the relative location of the moveable hydraulic piston 32 to the control panel (not shown), and a position holder 33 which is configured to mechanically assure that the actuating means 20 remains in the desired position by the operator if conditions in the hydraulic system change slightly in use. Also shown is a pressure transducer 35 communicating with the hydraulic circuitry 30, and transmitting collected data to the control panel (not shown) via the electrical conduit 23. As shown in FIG. 1C, a downstream pressure transducer 19 may be provided to cooperate with the pressure transducer 35 for measuring and reporting to the control panel any pressure drop across the variable orifice valve 16. It will be obvious to one skilled in the art that the electric motor 26 and downhole pump 22 have been used to eliminate the cost of running a control line from a surface pressure source. This representation should not be taken as a limitation. Obviously, a control line could be run from the surface to replace the electric motor 26 and downhole pump 22, and would be controlled in the same manner without altering the scope or spirit of this invention. When it is operationally desirable to open the variable orifice valve 16, an electric signal from the surface activates the electric motor 26 and the hydraulic pump 22, which routes pressure to the solenoid valve 28. The solenoid valve 28 also responding to stimulus from the control panel, shifts to a position to route hydraulic pressure to the moveable hydraulic piston 32 that opens the variable orifice valve 16. The variable orifice valve 16 may be stopped at intermediate positions between open and closed to adjust the flow of lift or injection gas 31 therethrough, and is held in place by the position holder 33. To close the valve, the solenoid valve 28 merely has to be moved to the opposite position rerouting hydraulic fluid to the opposite side of the moveable hydraulic piston 32, which then translates back to the closed position.

Figure 6:
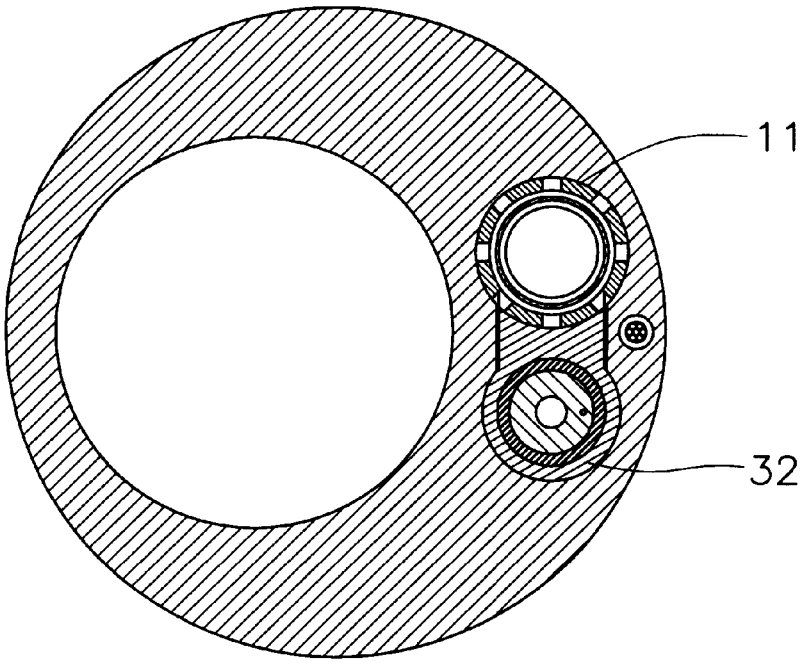
FIG. 6 is a cross-sectional view taken along line 6—6 of FIG. 1B.

As shown in FIG. 1B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 6, this embodiment of the present invention may also be provided with a valve connection collet 11, the structure and operation of which are well known to those of ordinary skill in the art.

Figure 2A:
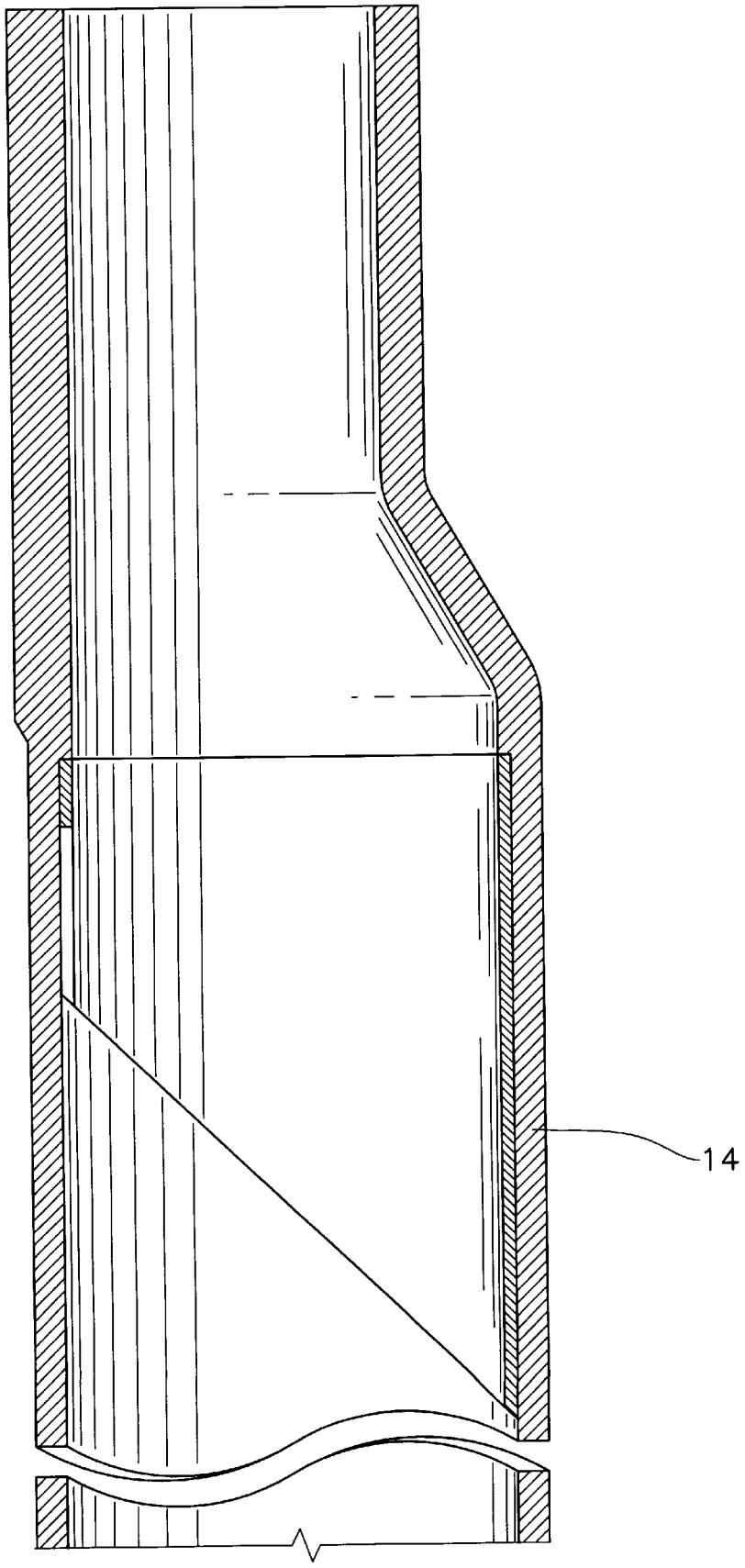
FIGS. 2A–2C are elevation views which together illustrate a hydraulically operated embodiment of the apparatus of the present invention connected to a single hydraulic control line running from the earth's surface; the power unit is shown rotated ninety degrees for clarity.
Figure 2B:
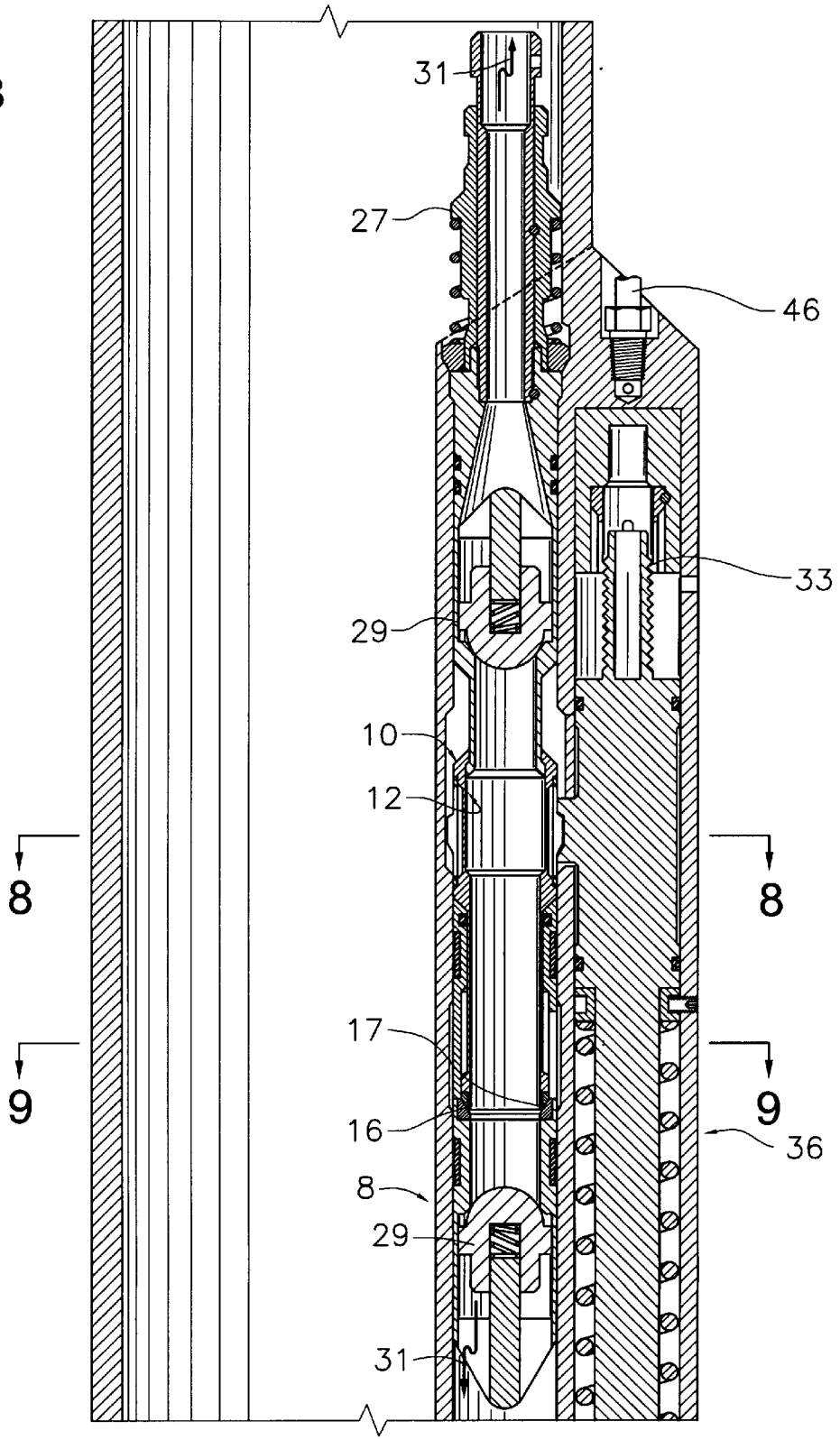
Figure 2C:
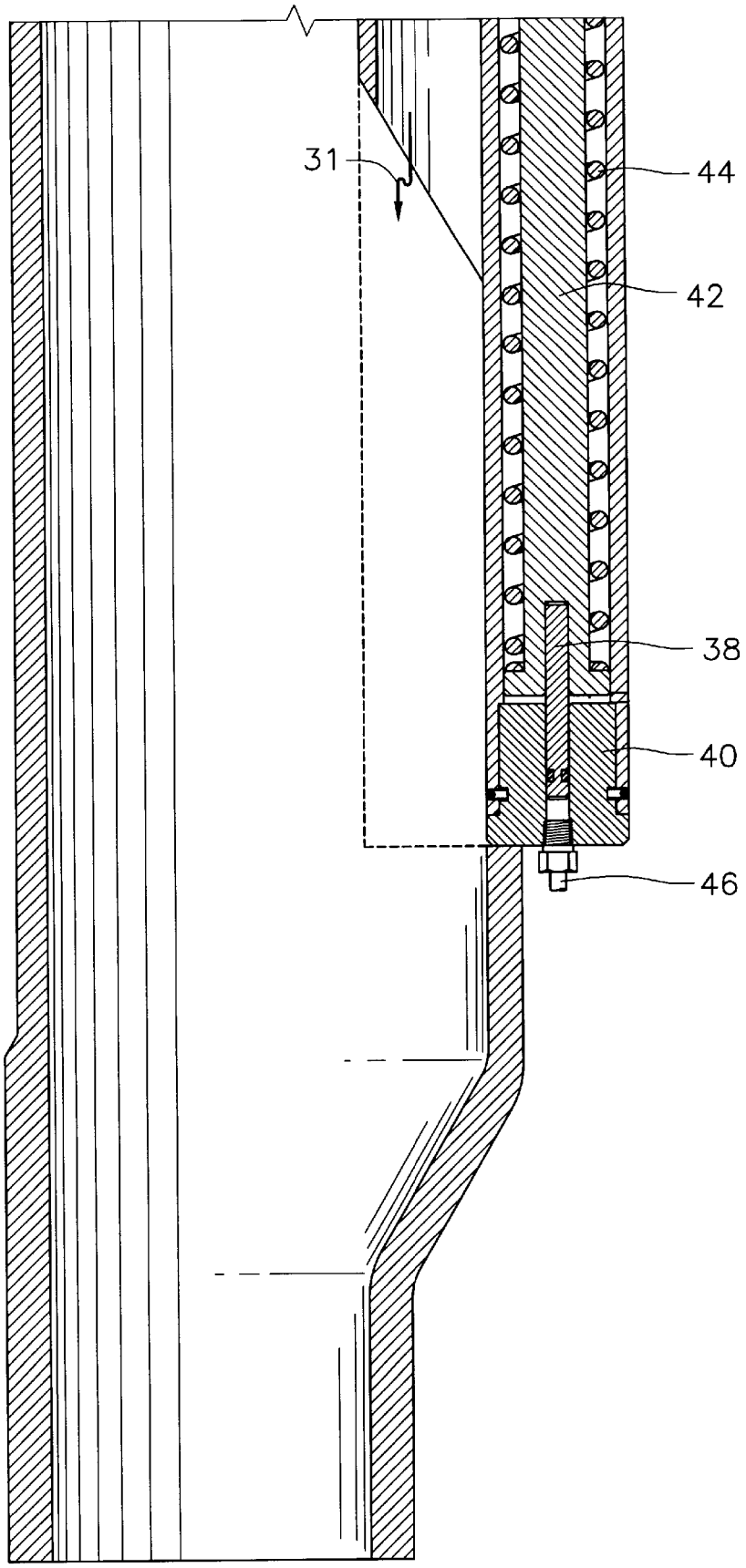
Figure 9:
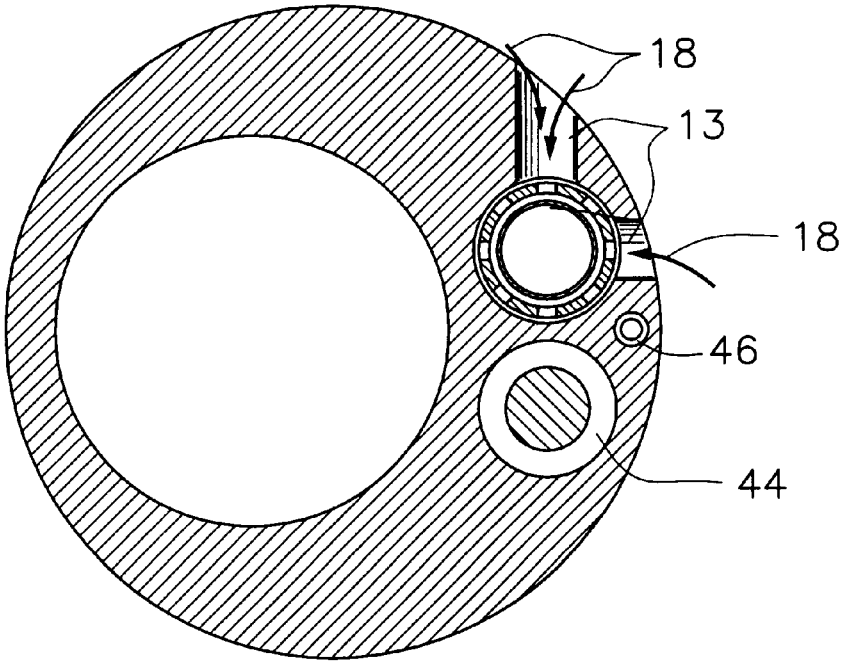
FIG. 9 is a cross-sectional view taken along line 9—9 of FIG. 2B.

FIGS. 2A–2C together depict a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18 —see FIG. 9) into said body through injection gas ports 13 in the mandrel 14, and an actuating means shown generally by numeral 36 that is hydraulically operated. Further illustrated is: a hydraulic actuating piston 38 located in a downhole housing 40 and operatively connected to a moveable piston 42, which is operatively connected to the variable orifice valve 16. A spring 44, biases said variable orifice valve 16 in either the full open or full closed position, and a control line 46 communicates with the hydraulic actuating piston 38 and extends to a hydraulic pressure source (not shown). When it is operationally desirable to open the variable orifice valve 16, hydraulic pressure is applied from the hydraulic pressure source (not shown), which communicates down the hydraulic control line 46 to the hydraulic actuating piston 38, which moves the moveable piston 42, which opens the variable orifice valve 16. The variable orifice valve 16 may be stopped at intermediate positions between open and closed to adjust the flow of lift or injection gas 31 therethrough, and is held in place by a position holder 33 which is configured to mechanically assure that the actuating means 36 remains in the position where set by the operator if conditions in the hydraulic system change slightly in use. The valve is closed by releasing the pressure on the control line 46, allowing the spring 44 to translate the moveable piston 42, and the variable orifice valve 16 back to the closed position.

Figure 8:
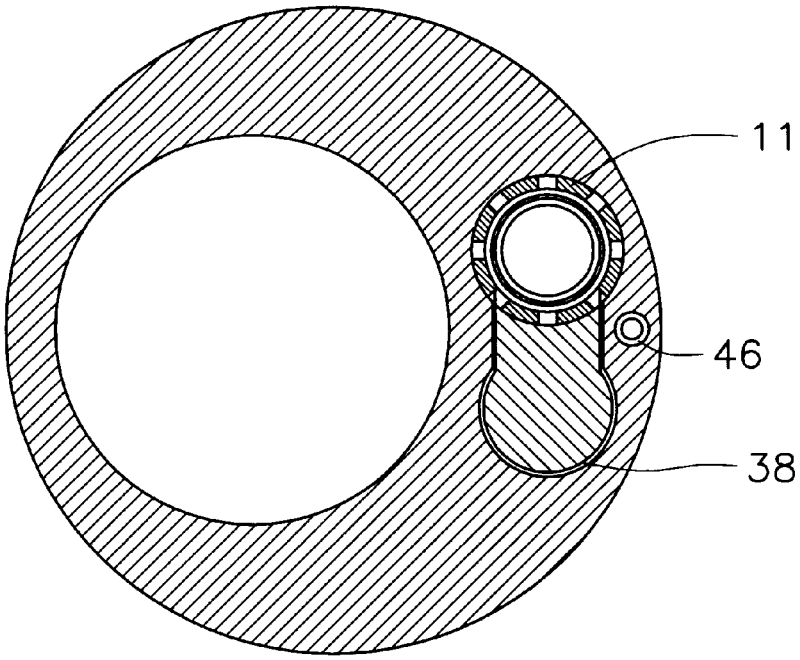
FIG. 8 is a cross-sectional view taken along line 8—8 of FIG. 2B.

As shown in FIG. 2B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 8, this embodiment of the present invention may also be provided with a valve connection collet 11, the structure and operation of which are well known to those of ordinary skill in the art.

Figure 3A:
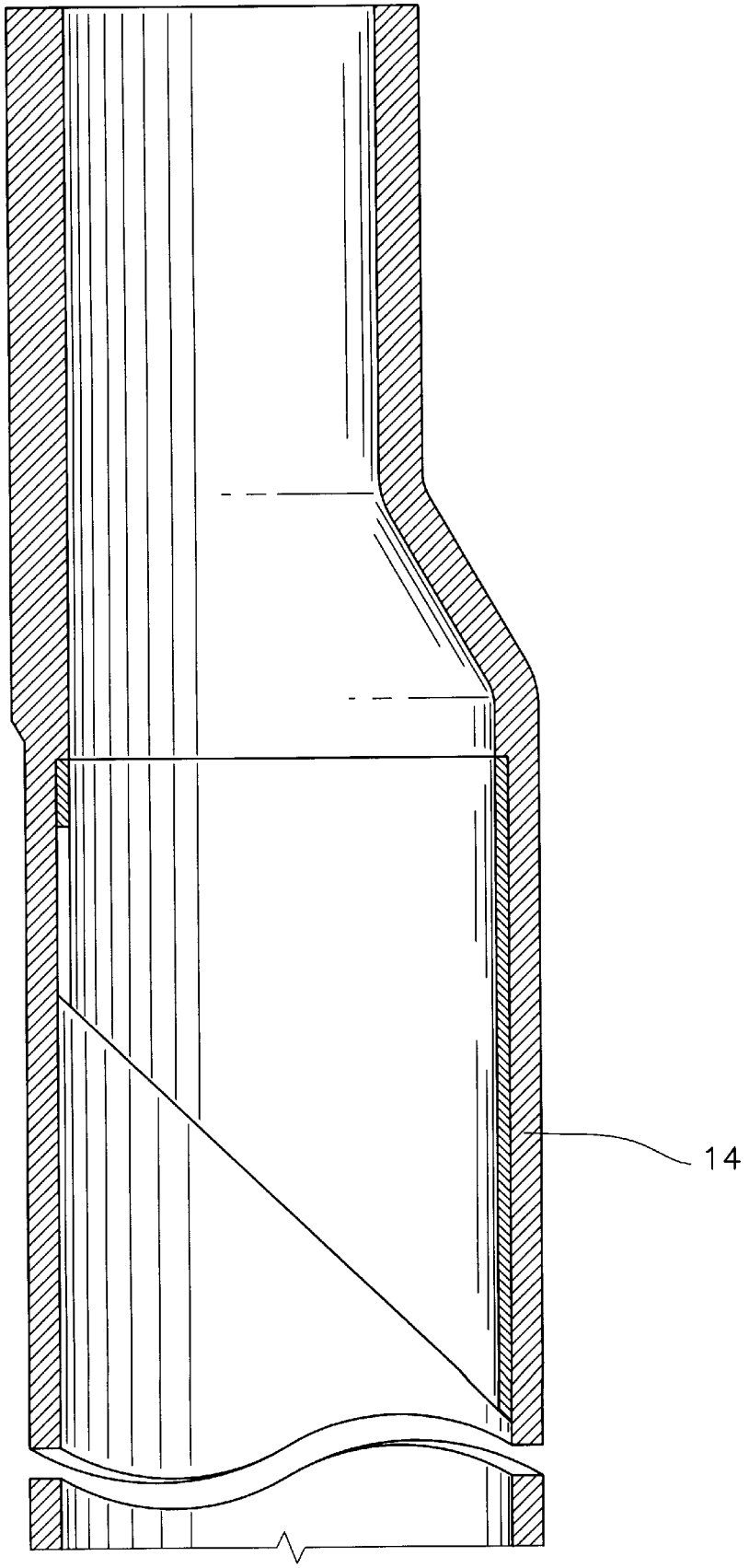
FIGS. 3A–3C are elevation views which together illustrate another hydraulically operated embodiment of the apparatus of the present invention connected to dual hydraulic control lines running from the earth's surface; the power unit is shown rotated ninety degrees for clarity.
Figure 3B:
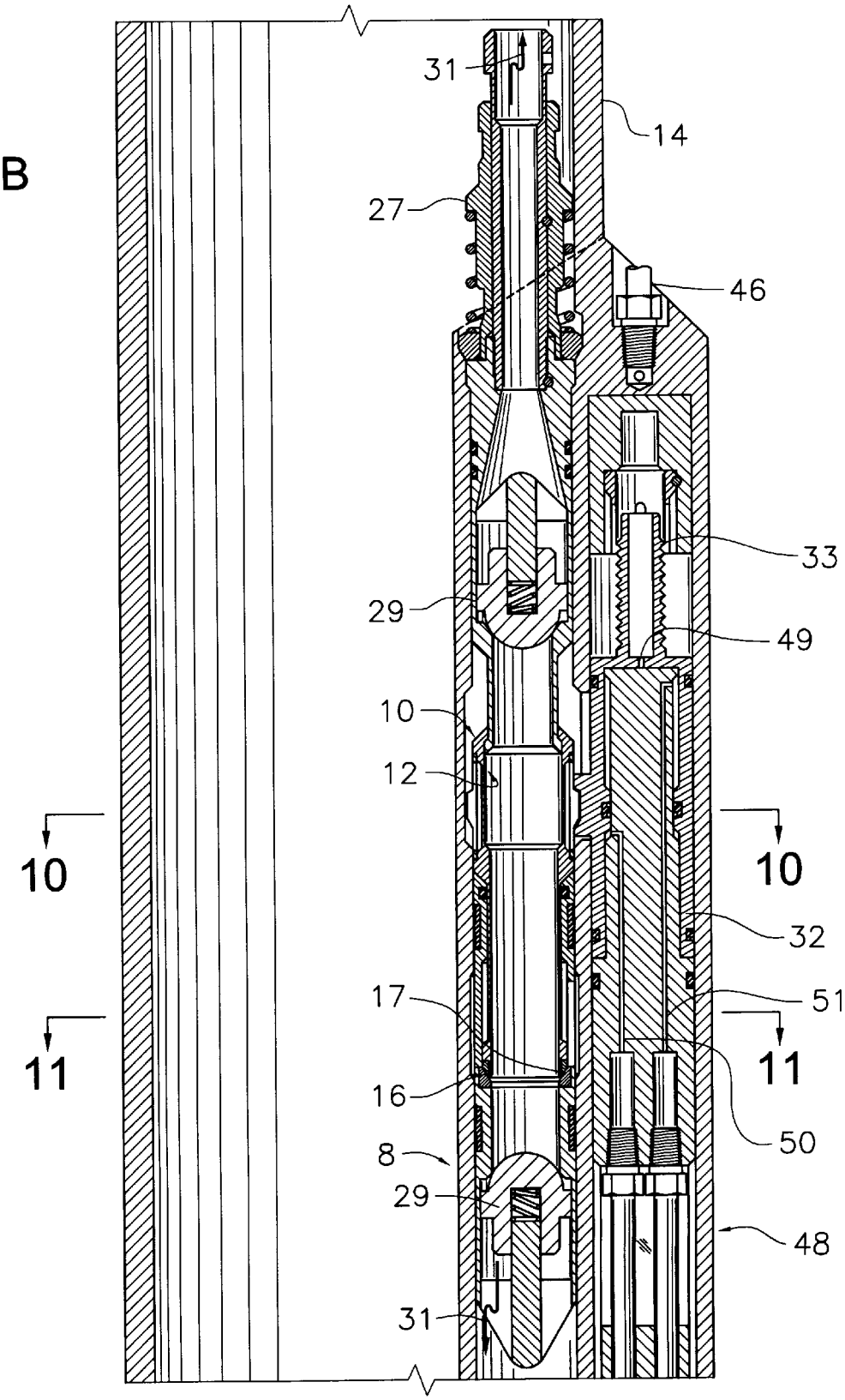
Figure 3C:
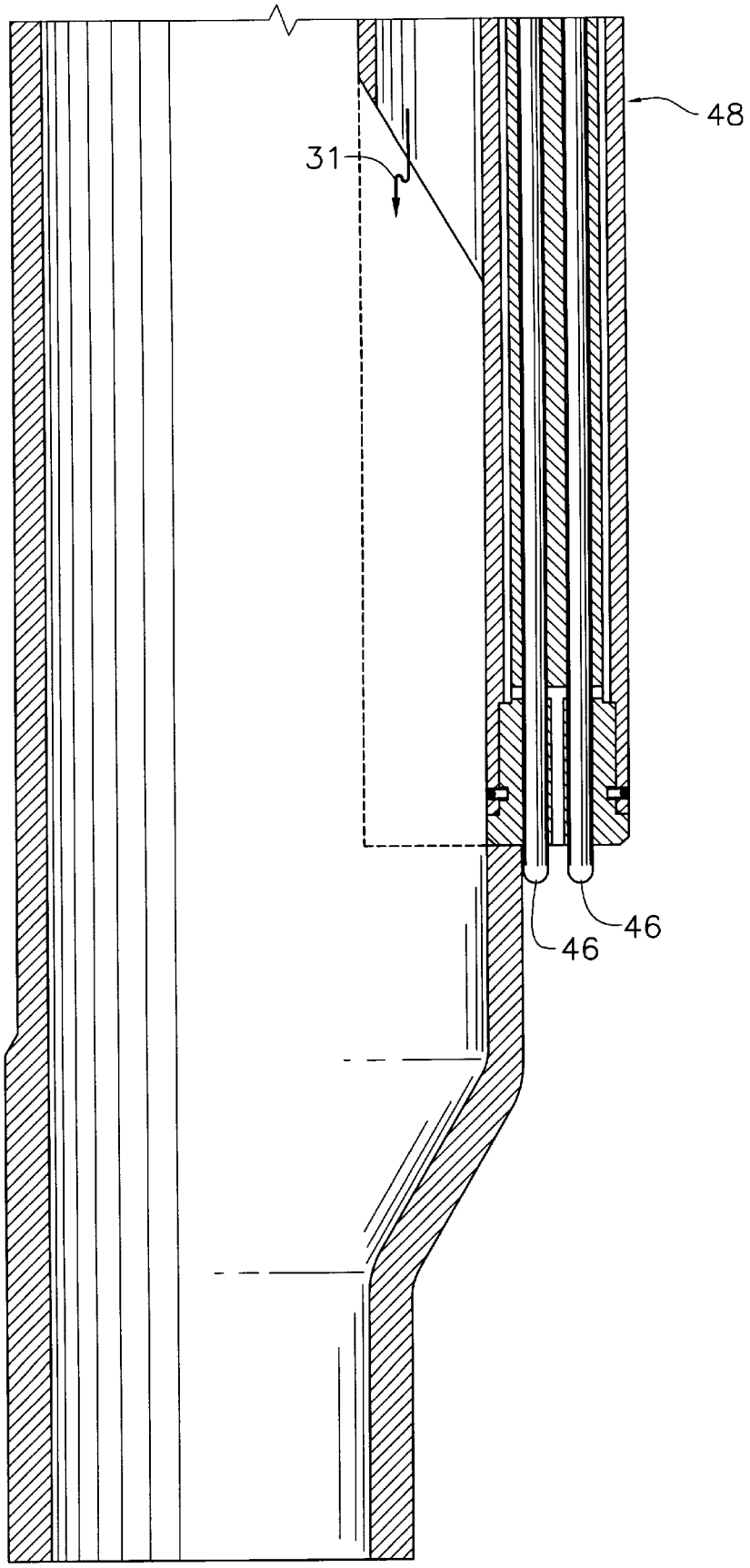
Figure 11:
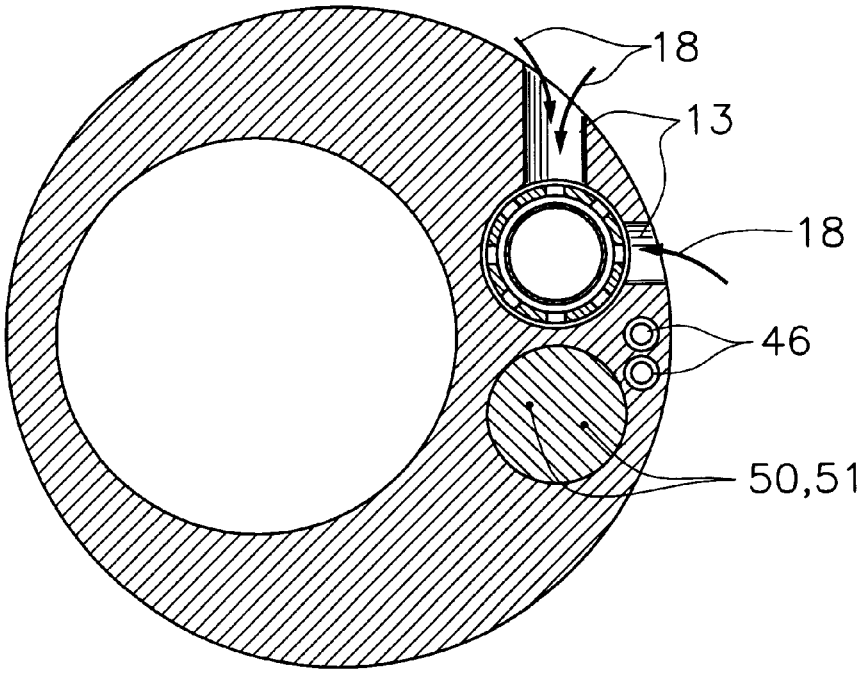
FIG. 11 is a cross-sectional view taken along line 11—11 of FIG. 3B.

FIGS. 3A–3C together disclose another embodiment of a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 11) into said body through injection gas ports 13 in the mandrel 14, and an actuating means shown generally by numeral 48 that is hydraulically operated. Further illustrated: hydraulic conduits 50 and 51 that route pressurized hydraulic fluid directly to a moveable piston 32, which is operatively connected to the variable orifice valve 16. Two control lines 46 extend to a hydraulic pressure source (not shown). The moveable hydraulic piston 32 responding to the pressure signal from the "valve open" hydraulic conduit 50 which opens and controls the movement of the variable orifice valve 16 while the "valve closed" hydraulic conduit 51 is bled off. The variable orifice valve 16 may be stopped at intermediate positions between open and closed to adjust the flow of lift or injection gas 31 to therethrough, and is held in place by a position holder 33 which is configured to mechanically assure that the actuating means 48 remains in the position where set by the operator if conditions in the hydraulic system change slightly in use. Closure of the variable orifice valve 16 is accomplished by sending a pressure signal down the "valve closed" hydraulic conduit 51, and simultaneously bleeding pressure from the "valve open" hydraulic conduit 50.

Figure 10:
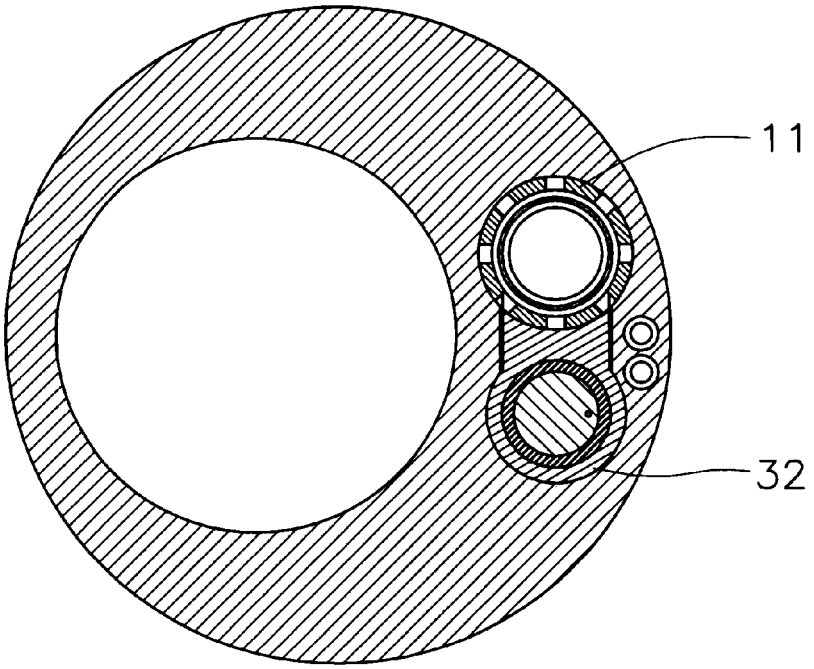
FIG. 10 is a cross-sectional view taken along line 10—10 of FIG. 3B.

A fluid displacement control port 49 may also be provided for use during the bleeding off of the conduits 50 and 51, in a manner well known to those of ordinary skill in the art. As shown in FIG. 3B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 10, this embodiment of the present invention may also be provided with a valve connection collet 11, the structure and operation of which are well known to those of ordinary skill in the art.

Figure 4A:
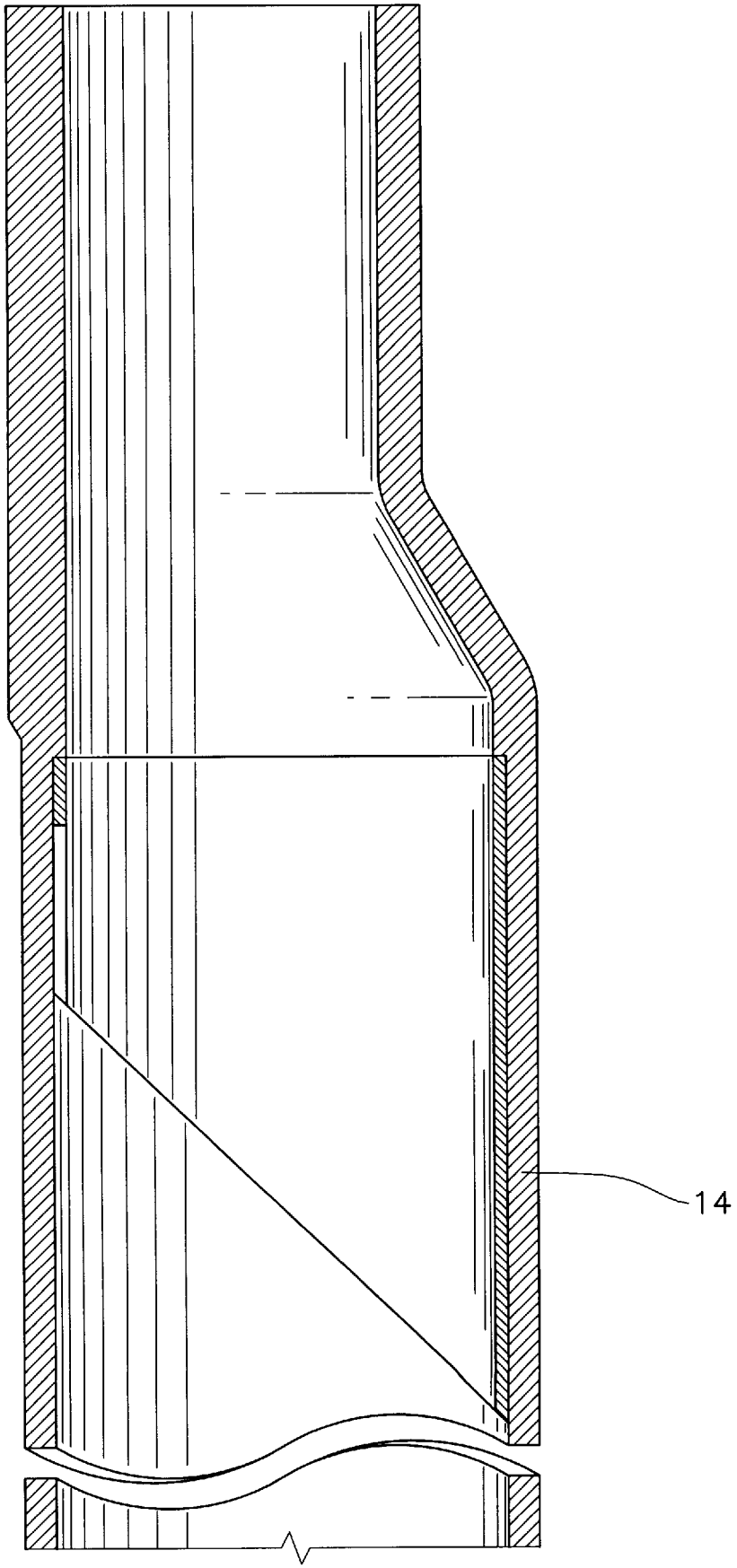
FIGS. 4A–4C are elevation views which together illustrate another hydraulically operated embodiment of the apparatus of the present invention connected to dual hydraulic control lines running from the earth's surface; the power unit is shown rotated ninety degrees for clarity.
Figure 4B:
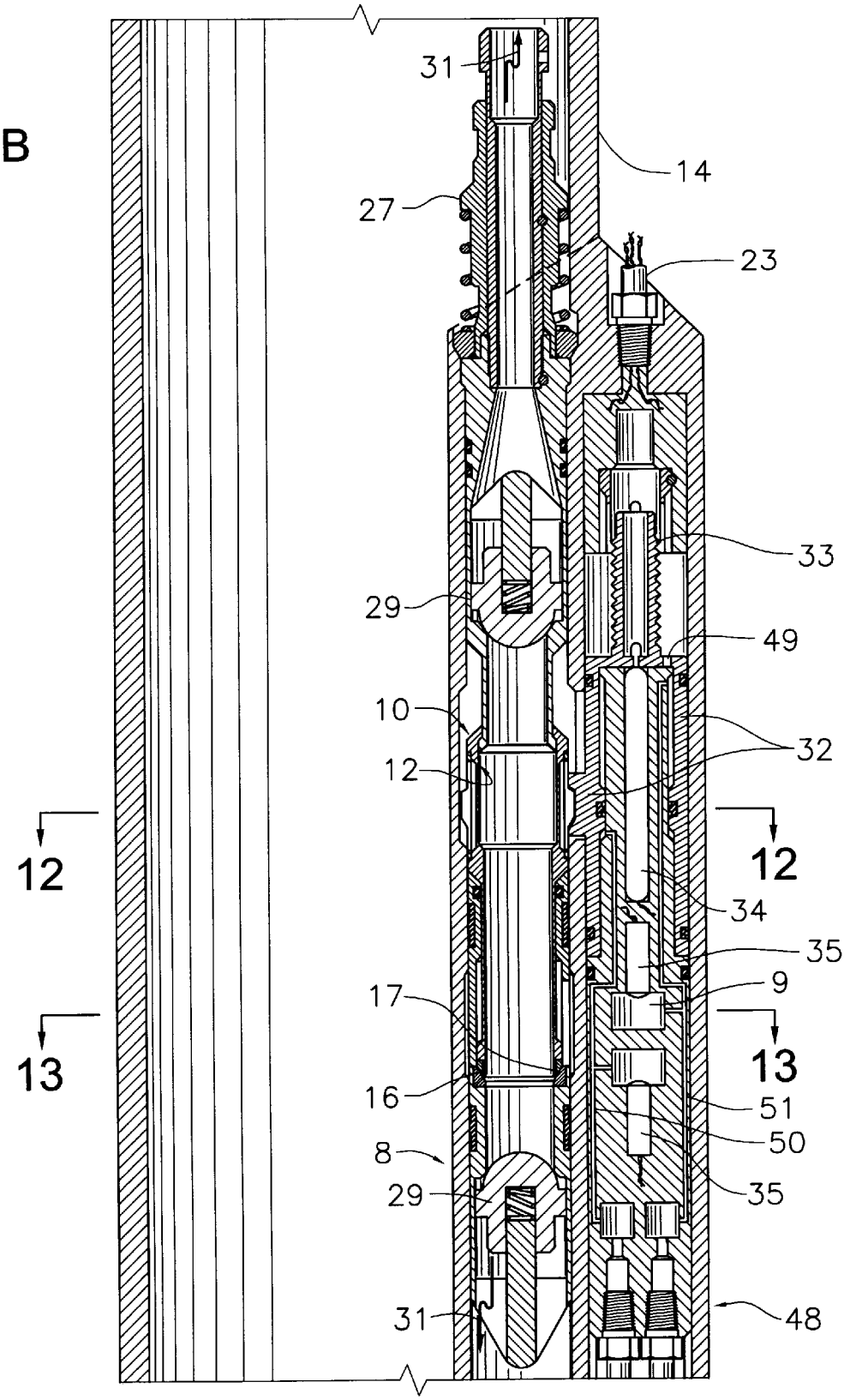
Figure 4C:
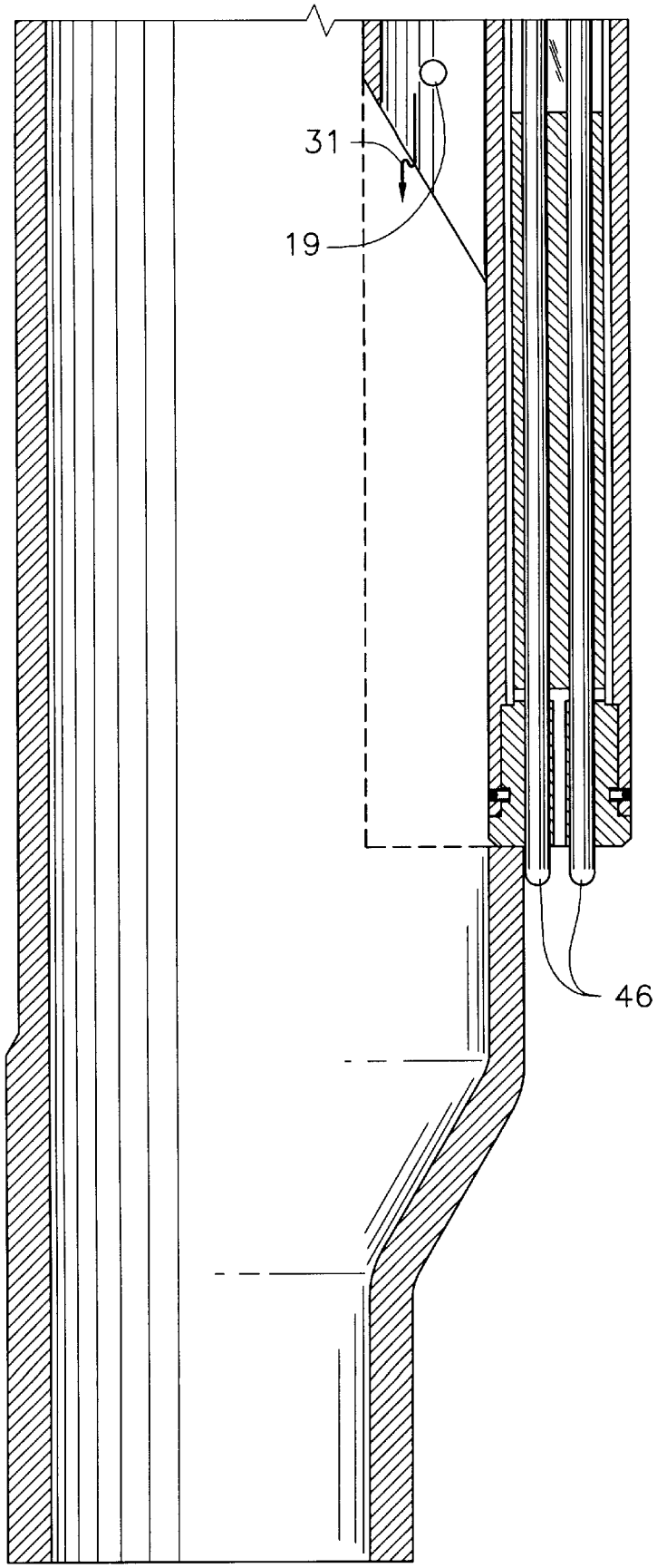
Figure 13:
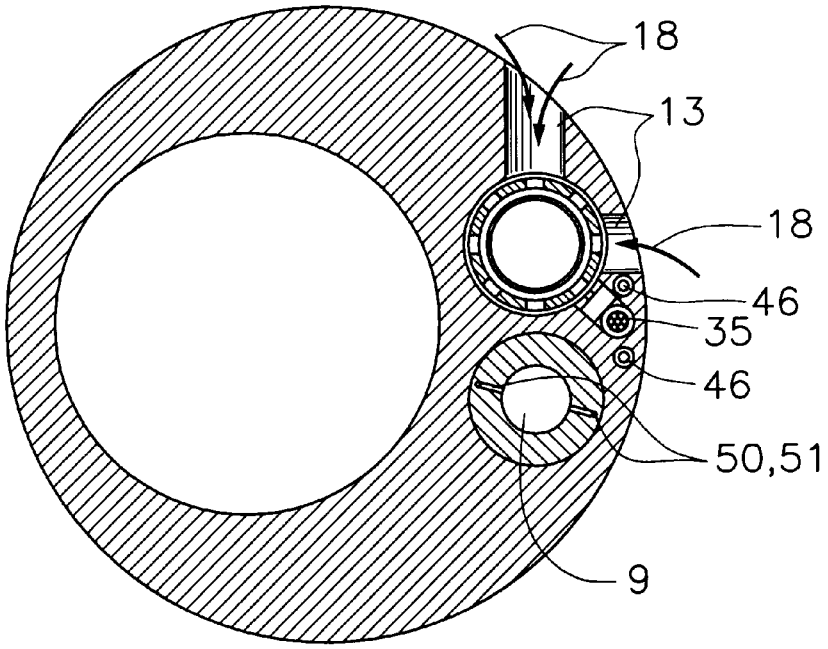
FIG. 13 is a cross-sectional view taken along line 13—13 of FIG. 4B.

FIGS. 4A–4C together depict a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18 —see FIG. 13) into said body through injection gas ports 13 in the mandrel 14, and an actuating means shown generally by numeral 48 that is hydraulically operated. Further illustrated: hydraulic conduits 50 and 51 that route pressurized hydraulic fluid directly to a moveable piston 32, which is operatively connected to the variable orifice valve 16, and two control lines 46 extending to a hydraulic pressure source (not shown). The movable hydraulic piston 32 responding to the pressure signal from the "valve open" hydraulic conduit 50 which opens and controls the movement of the variable orifice valve 16 while the "valve closed" hydraulic conduit 51 is bled off. The variable orifice valve 16 may be stopped at intermediate positions between open and closed to adjust the flow of lift or injection gas 31 therethrough, and is held in place by a position holder 33 which is configured to mechanically assure that the actuating means 20 remains in the position where set by the operator if conditions in the hydraulic system change slightly in use. Closure of the variable orifice valve 16 is accomplished by sending a pressure signal down the "valve closed" hydraulic conduit 51, and simultaneously bleeding pressure from the "valve open" hydraulic conduit 50. The actuator has a position sensor 34 which reports the relative location of the moveable hydraulic piston 32 to the control panel (not shown) via an electrical conduit 23. Also shown are pressure transducers 35 communicating with the hydraulic conduits 50 and 51 through hydraulic pressure sensor chambers (e.g., conduit 51 communicates with chamber 9), and transmitting collected data to the control panel (not shown) via the electrical conduit 23.

Figure 12:
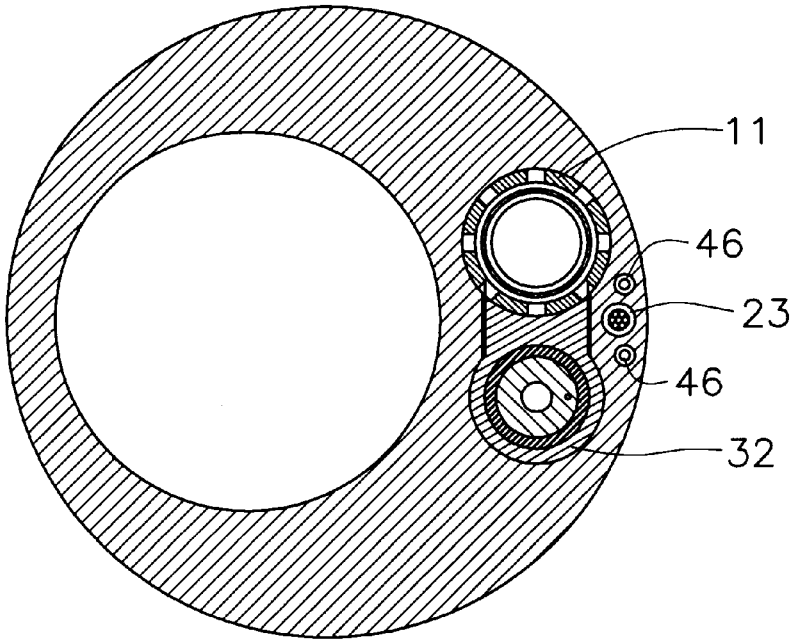
FIG. 12 is a cross-sectional view taken along line 12—12 of FIG. 4B.

As shown in FIG. 4C, a downstream pressure transducer 19 may be provided to cooperate with the pressure transducer 35 for measuring and reporting to the control panel any pressure drop across the variable orifice valve 16. As shown in FIG. 4B, a fluid displacement control port 49 may also be provided for use during the bleeding off of the conduits 50 and 51, in a manner well known to those of ordinary skill in the art. As also shown in FIG. 4B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 12, this embodiment of the present invention may also be provided with a valve connection collet 11, the structure and operation of which are well known to those of ordinary skill in the art.

Figure 5A:
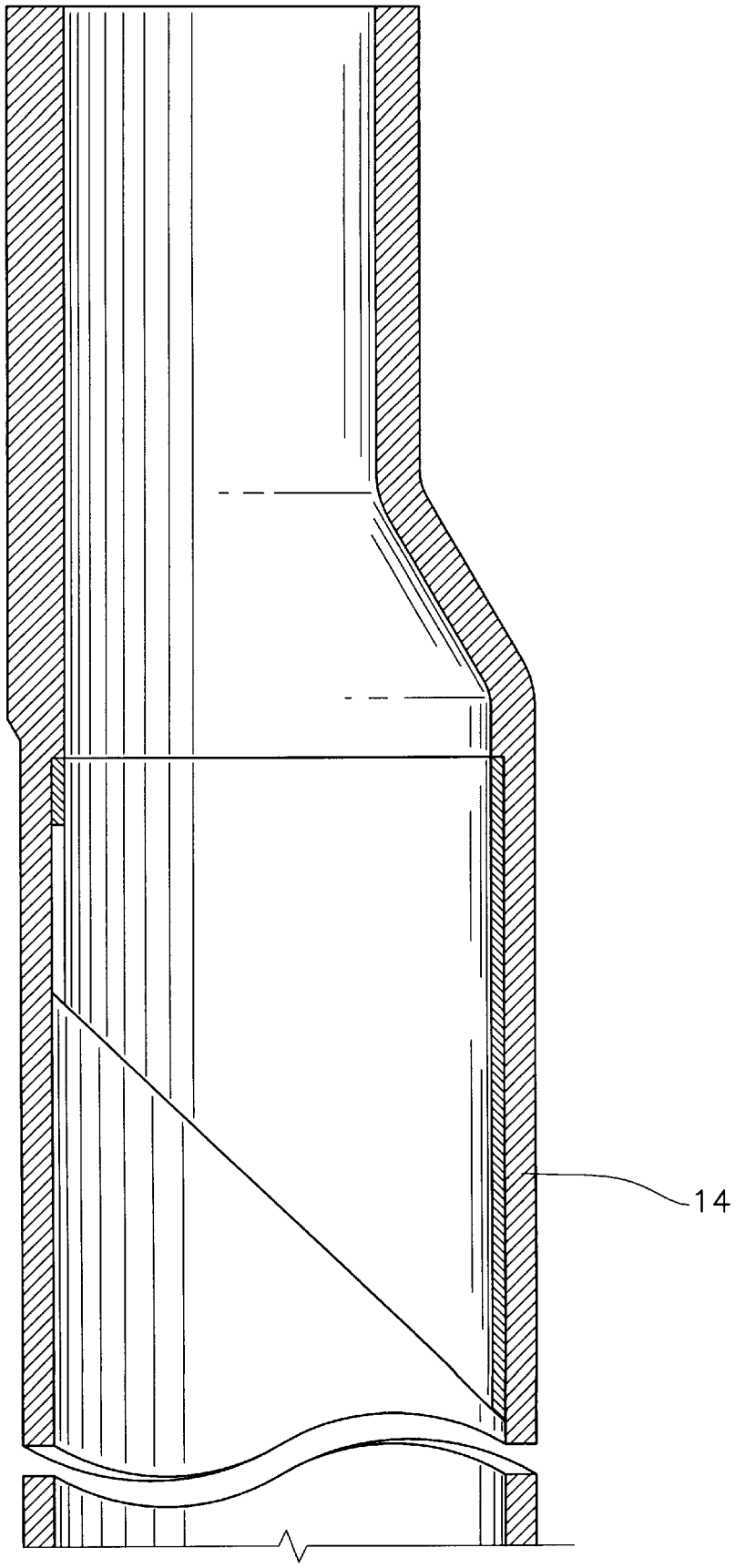
FIGS. 5A–5C are elevation views which together illustrate a pneumatic-hydraulically operated embodiment of the apparatus of the present invention connected to a single hydraulic control line running from the earth's surface; the power unit is shown rotated ninety degrees for clarity.
Figure 5B:
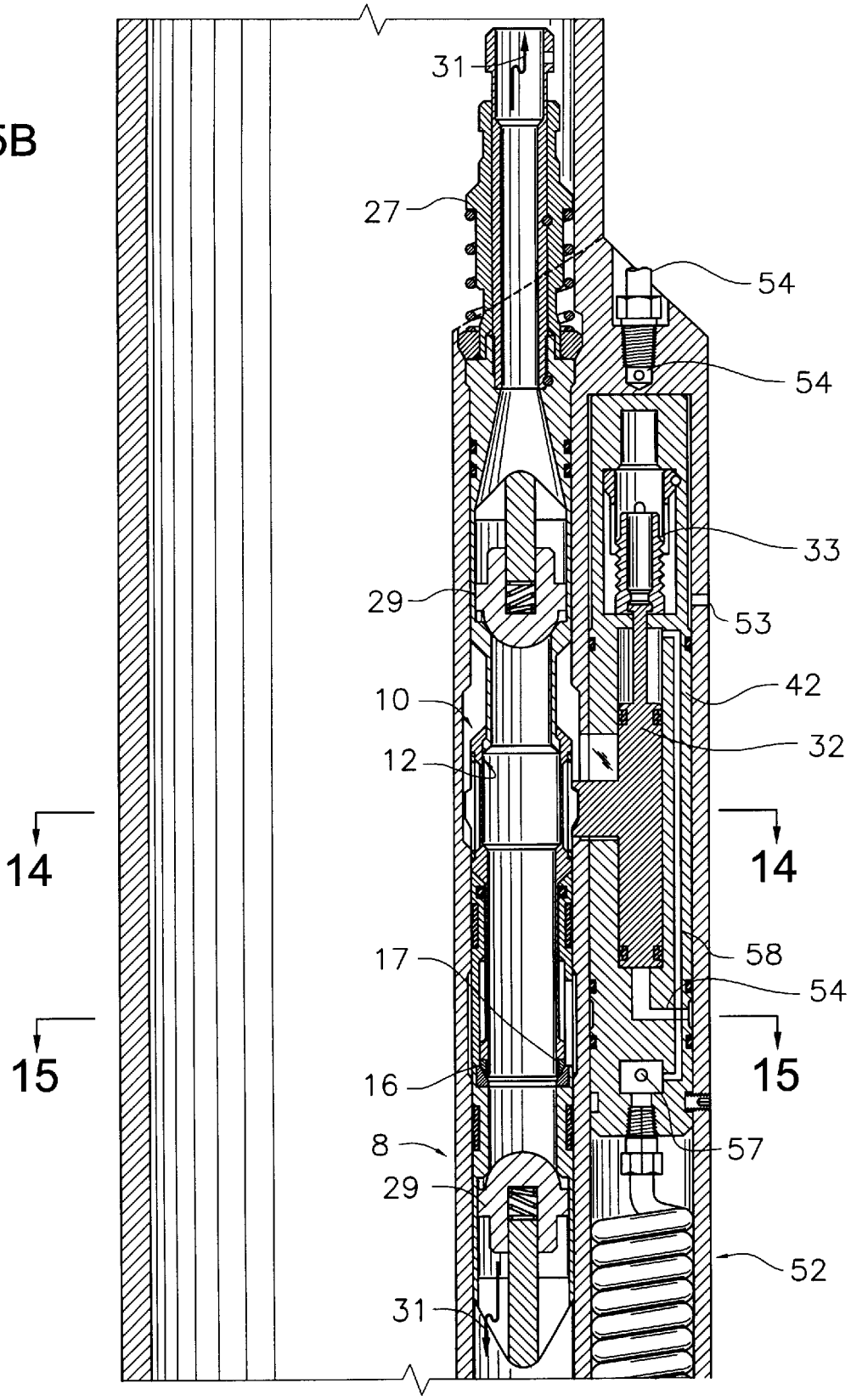
Figure 5C:
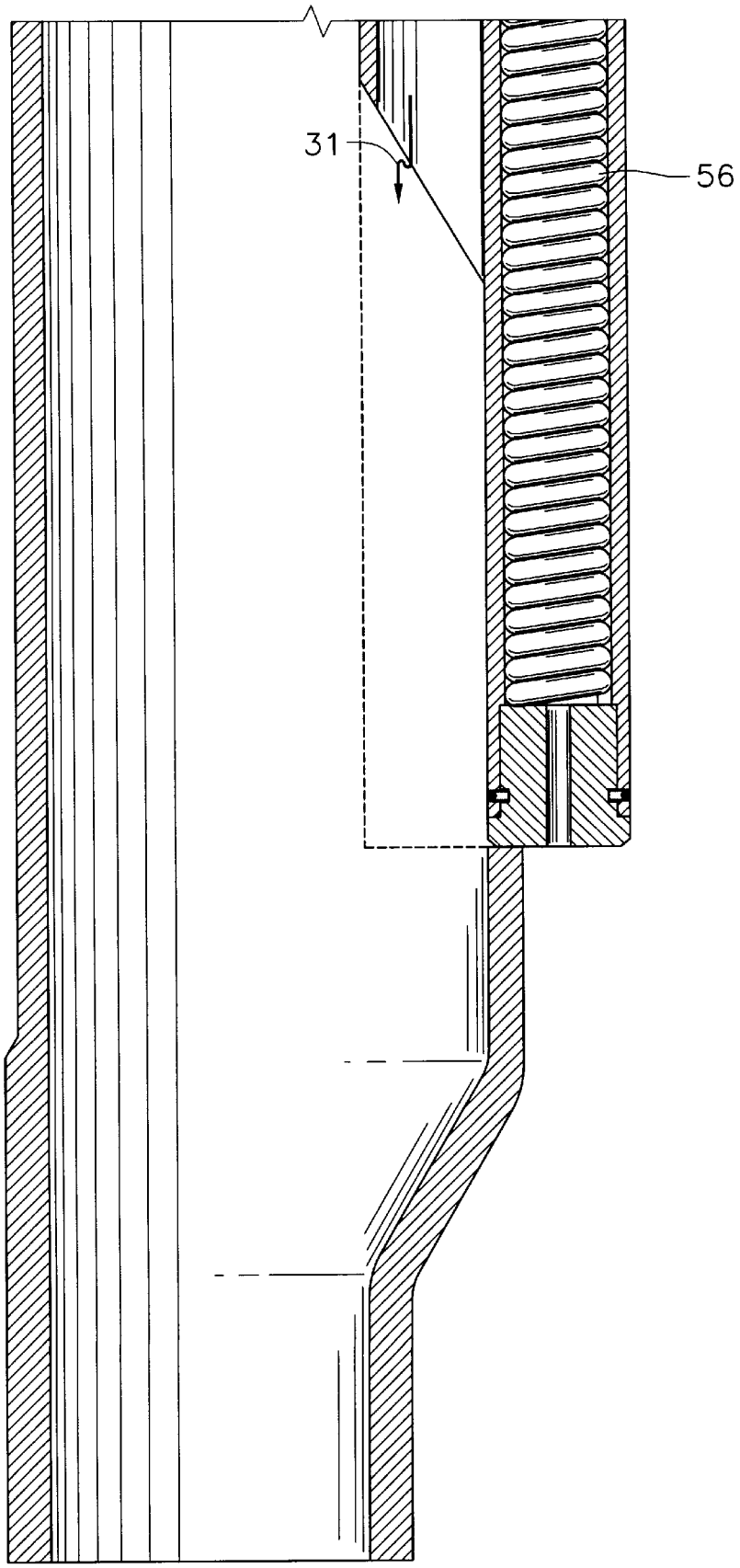
Figure 15:
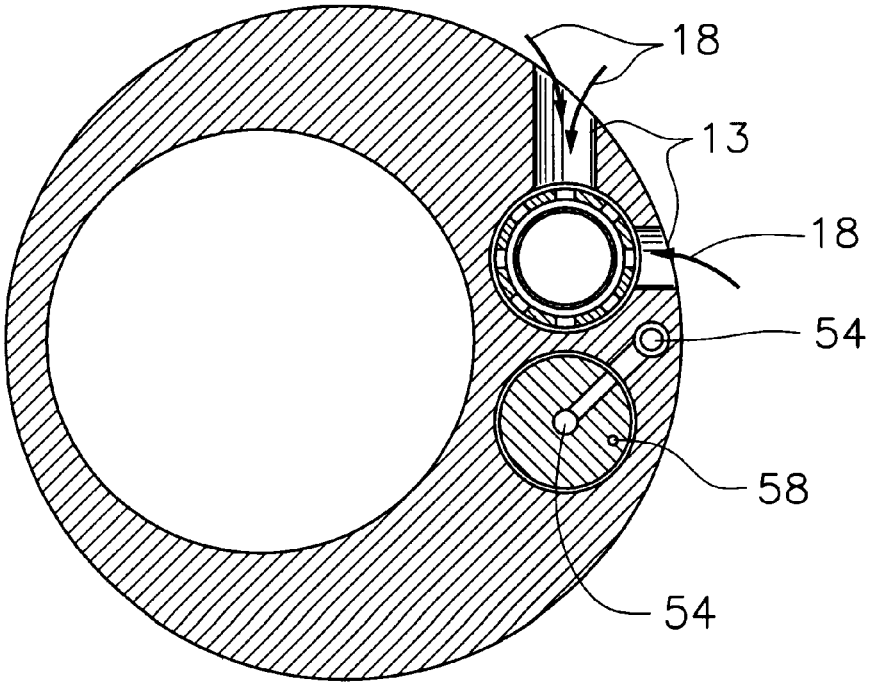
FIG. 15 is a cross-sectional view taken along line 15—15 of FIG. 5B.

FIGS. 5A–5C together depict a semidiagrammatic cross section of a gas lift valve 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18 —see FIG. 15) into said body through injection gas ports 13 in the mandrel 14, and an actuating means shown generally by numeral 52 that is hydraulically operated. Further illustrated: a hydraulic conduit 54 that routes pressurized hydraulic fluid directly to a moveable piston 32, which is operatively connected to the variable orifice valve 16. Hydraulic pressure is opposed by a pressurized nitrogen charge inside of a nitrogen coil chamber 56, the pressure of which is routed through a pneumatic conduit 58, which acts on an opposite end of the moveable hydraulic piston 32, biasing the variable orifice valve 16 in the closed position. The nitrogen coil chamber 56 is charged with nitrogen through a nitrogen charging port 57. When it is operationally desirable to open the variable orifice valve 16, hydraulic pressure is added to the control line 54, which overcomes pneumatic pressure in the pneumatic conduit 58 and nitrogen coil chamber 56, and translates the moveable piston 32 upward to open the variable orifice valve 16. As before, the variable orifice valve 16 may be stopped at intermediate positions between open and closed to adjust the flow of lift or injection gas 31 therethrough, and is held in place by a position holder 33 which is configured to mechanically assure that the actuating means 52 remains in the position where set by the operator if conditions in the hydraulic system change slightly in use. Closing the variable orifice valve 16 is accomplished by bleeding off the pressure from the control line 54, which causes the pneumatic pressure in the nitrogen coil chamber 56 to close the valve because it is higher than the hydraulic pressure in the hydraulic conduit 54. An annulus port 53 may also be provided through the wall of the mandrel 14 through which pressure may be discharged to the annulus during operation.

Figure 14:
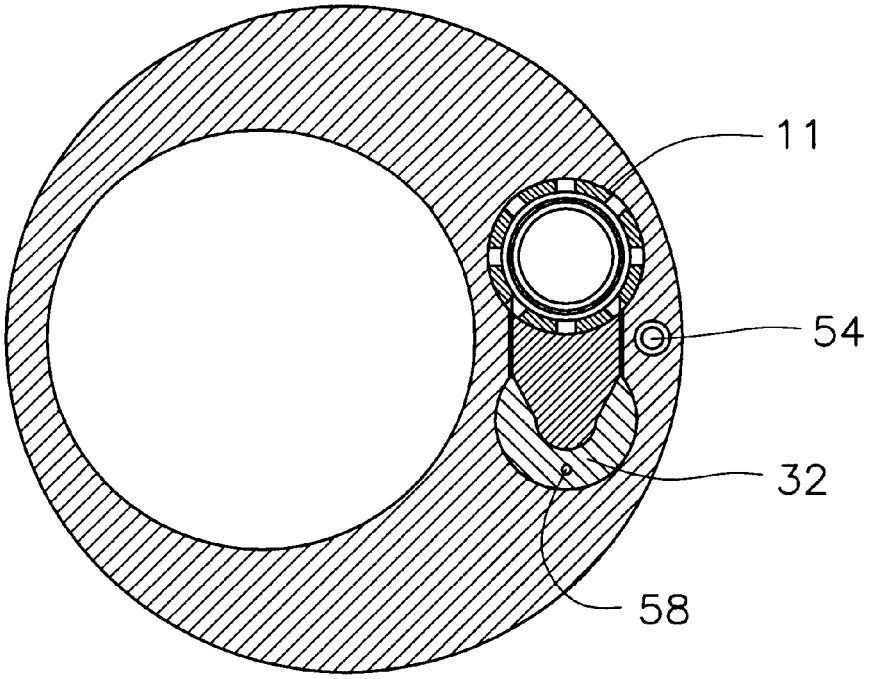
FIG. 14 is a cross-sectional view taken along line 14—14 of FIG. 5B.

As shown in FIG. 5B, the variable orifice valve 16 may include a carbide stem and seat 17. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 14, this embodiment of the present invention may also be provided with a valve connection collet 11, the structure and operation of which are well known to those of ordinary skill in the art.

Figure 16:
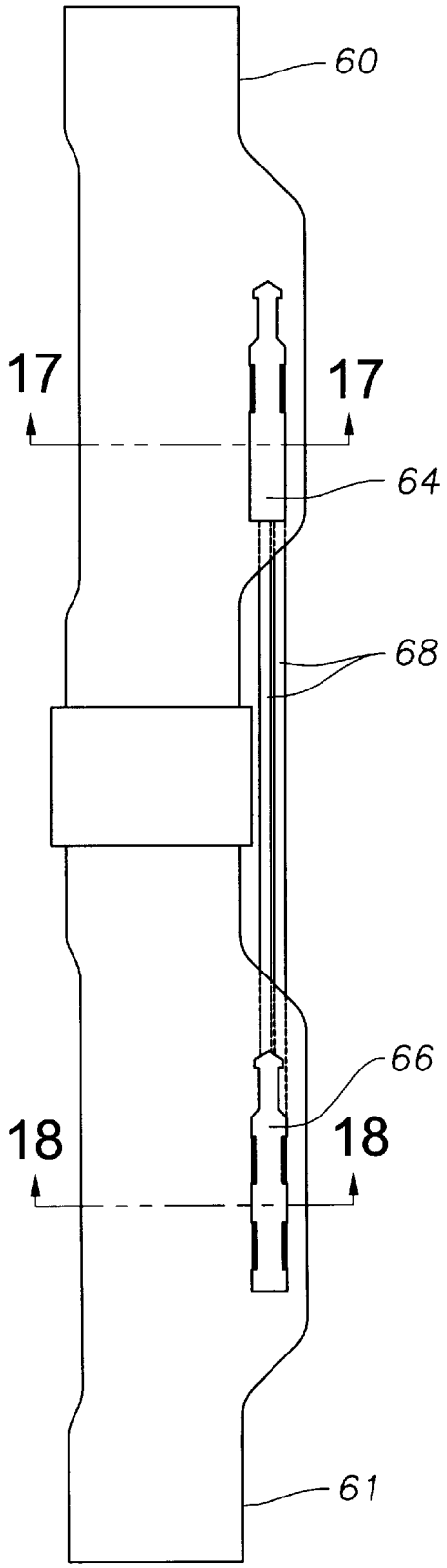
FIG. 16 is a schematic representation of another embodiment of the present invention with a retrievable actuator positioned in an upper mandrel and a retrievable variable orifice gas lift valve positioned in a lowermost mandrel.
Figure 17:
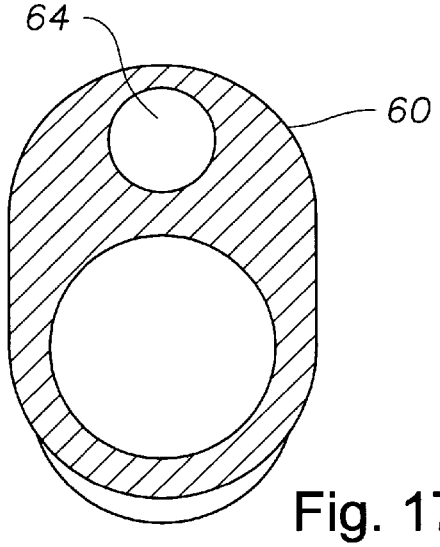
FIG. 17 is a cross-sectional view taken along line 17—17 of FIG. 16.
Figure 18:
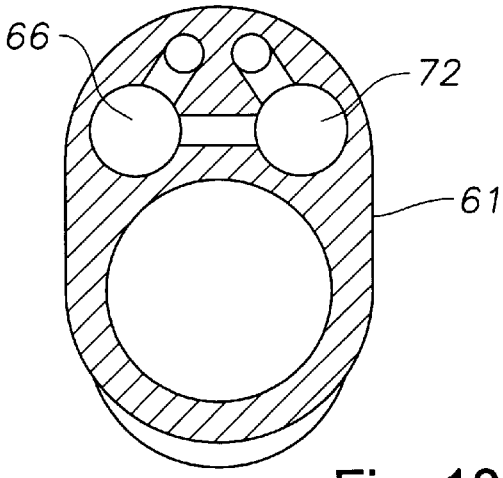
FIG. 18 is a cross-sectional view taken along line 18—18 of FIG. 16.

FIG. 16 is a schematic representation of one preferred embodiment of the present invention. Disclosed are uppermost and lowermost side pocket mandrels 60 and 61 sealably connected by a well coupling 62. A coiled tubing or wireline retrievable actuator 64 is positioned in the uppermost mandrel 60, and a variable orifice gas lift valve 66 is positioned in the lowermost mandrel 61, and are operatively connected by hydraulic control lines 68. In previous figures, the variable orifice valve 16 and the actuating mechanisms described in FIGS. 1–5 are shown located in the same mandrel, making retrieval of both mechanisms difficult, if not impossible. In this embodiment, the variable orifice gas lift valve 66, and the electro-hydraulic wireline or coiled tubing retrievable actuator 64 of the present invention are located, installed and retrieved separately, but are operatively connected one to another by hydraulic control lines 68. This allows retrieval of each mechanism separately, using either wireline or coiled tubing intervention methods which are well known in the art. As shown in FIG. 18, which is a cross-sectional view taken along line 18—18 of FIG. 16, an operating piston 72 is disposed adjacent the variable orifice valve 66 in the lowermost mandrel 61. In every other aspect, however, the mechanisms operate as heretofore described.

It should be noted that the preferred embodiments described herein employ a well known valve mechanism generically known as a poppet valve to those skilled in the art of valve mechanics. It can, however, be appreciated that several well known valve mechanisms may obviously be employed and still be within the scope and spirit of the present invention. Rotating balls or plugs, butterfly valves, rising stem gates, and flappers are several other generic valve mechanisms which may obviously be employed to accomplish the same function in the same manner.

Figure 20:
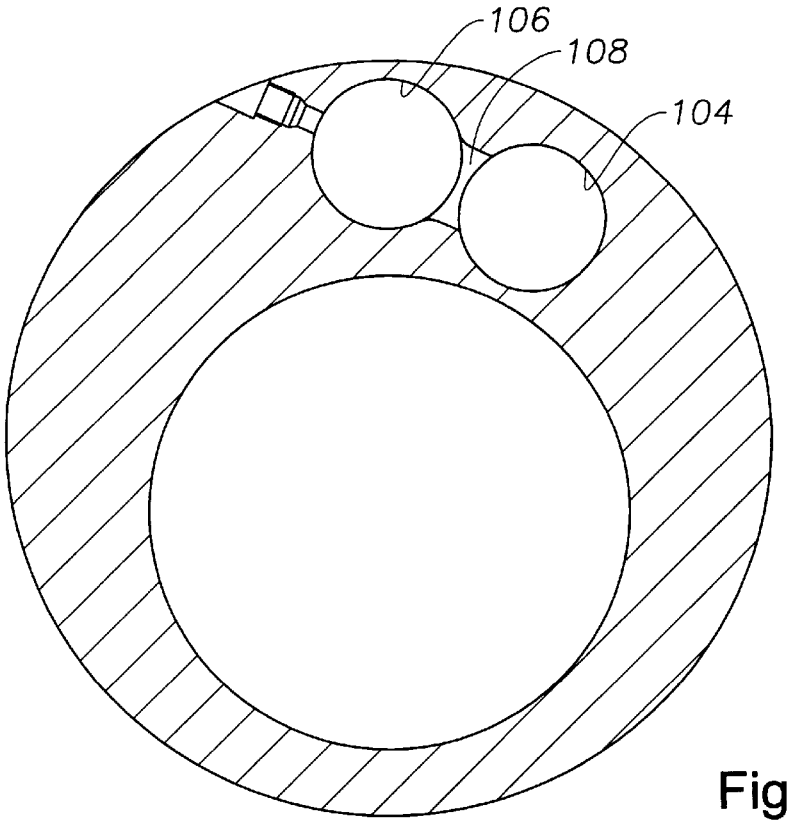
FIG. 20 is a cross-sectional view taken along line 20—20 of FIG. 19D.
Figure 21:
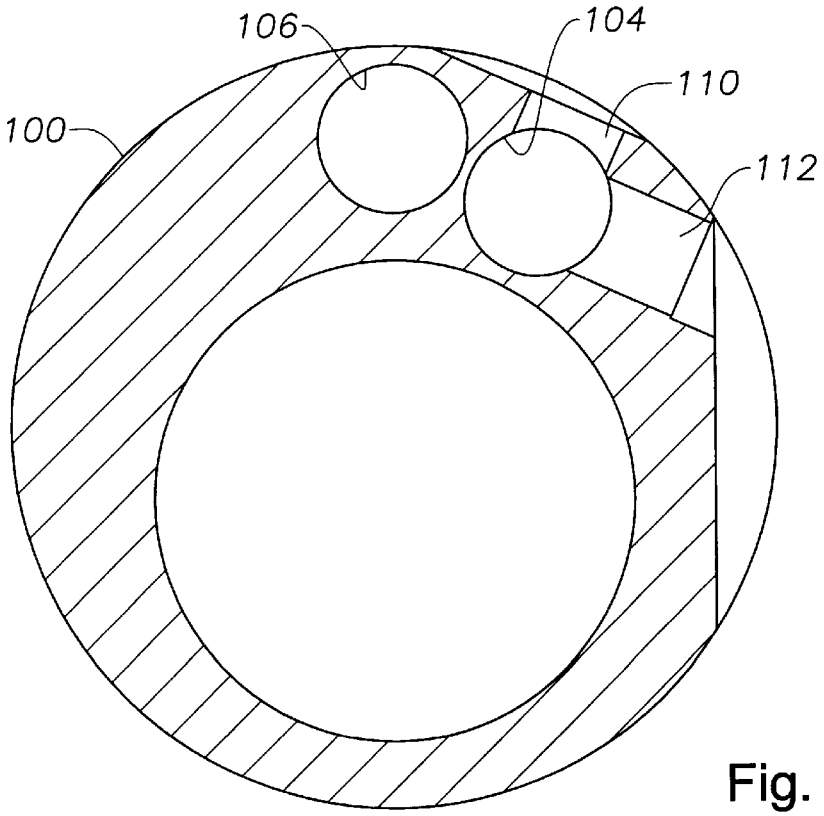
FIG. 21 is a cross-sectional view taken along line 21—21 of FIG. 19D.

Another aspect of the present invention broadly relates to orienting the gas lift valve 8 relative to certain distinct locations on the mandrel 14. This aspect of the present invention will be explained in part with reference to portions of FIGS. 1 to 18, discussed above, but for the most part will be explained and described with references to FIGS. 19 to 29. Referring initially to FIGS. 19A to 19E, there is shown a side pocket mandrel 100 having a locating and orienting sleeve 102 for locating and aligning a kickover tool (not shown) to which a gas lift valve (not shown) is attached. Locating and orienting sleeves, such as the sleeve 102, and kickover tools are well known to those of ordinary skill in the art. As best shown in FIG. 20, which is a cross-sectional view taken along line 20—20 of FIG. 19D, the mandrel 100 includes a first pocket 104 and a second pocket 106. The first and second pockets 104 and 106 are substantially parallel to one another. The first pocket 104 is for receiving a gas lift valve (not shown here). The second pocket 106 is for housing an independent power source, such as any of the various actuators discussed above and shown in FIGS. 1–18. The second pocket 106 is sometimes referred to as a "blind" pocket because it is enclosed, whereas the top of the first pocket 104 is open so it can receive a gas lift valve. As shown in FIGS. 19D and 21, the mandrel 100 may further include a window 108 that connects the first pocket 104 and the second pocket 106. As best shown in FIG. 21, which is a cross-sectional view taken along line 21—21 of FIG. 19D, the mandrel 100 may further include a first fluid flow port 110 and a second fluid flow port 112. In a specific embodiment, the flow ports 110 and 112 may be positioned in the mandrel 100 at right, or 90 degree, angles to one another.

Figure 19A:
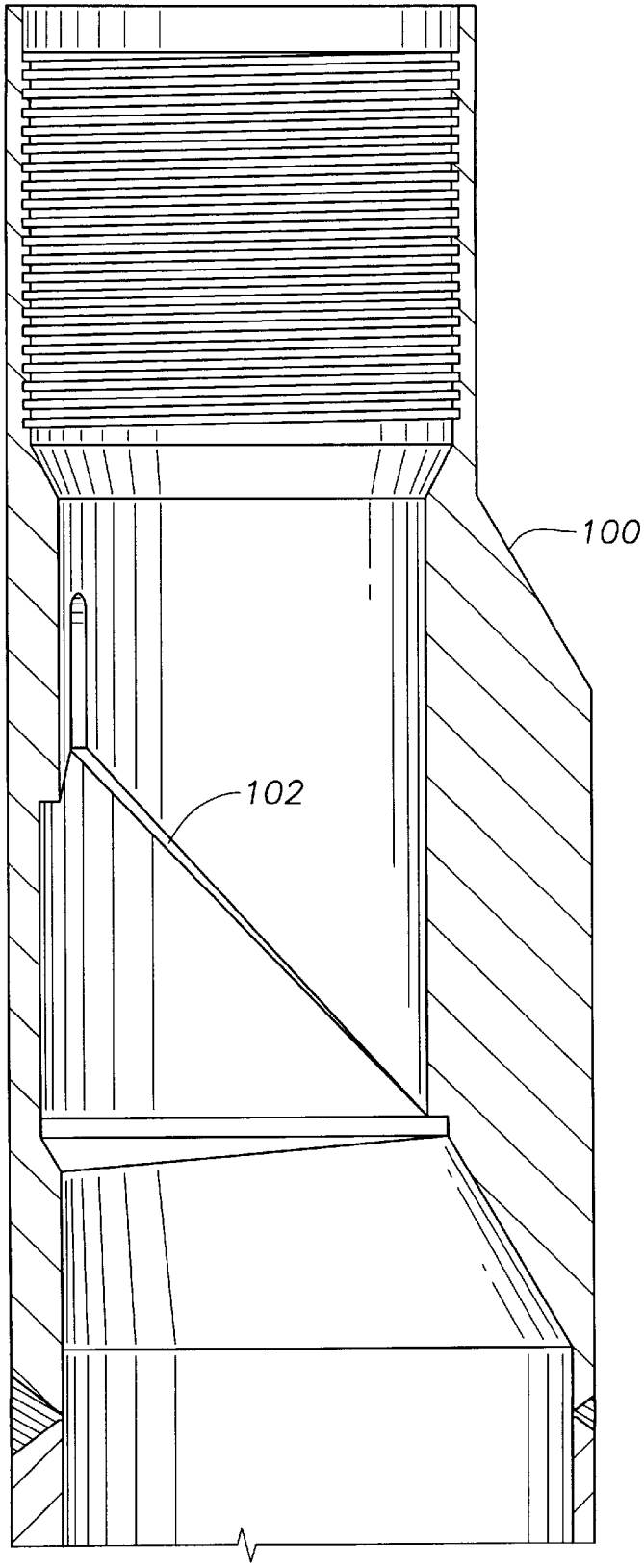
FIGS. 19A–19E are elevation views which together illustrate a side pocket mandrel having a first pocket for receiving a gas lift valve and a second pocket, parallel to the first pocket, for receiving a actuator.
Figure 19B:
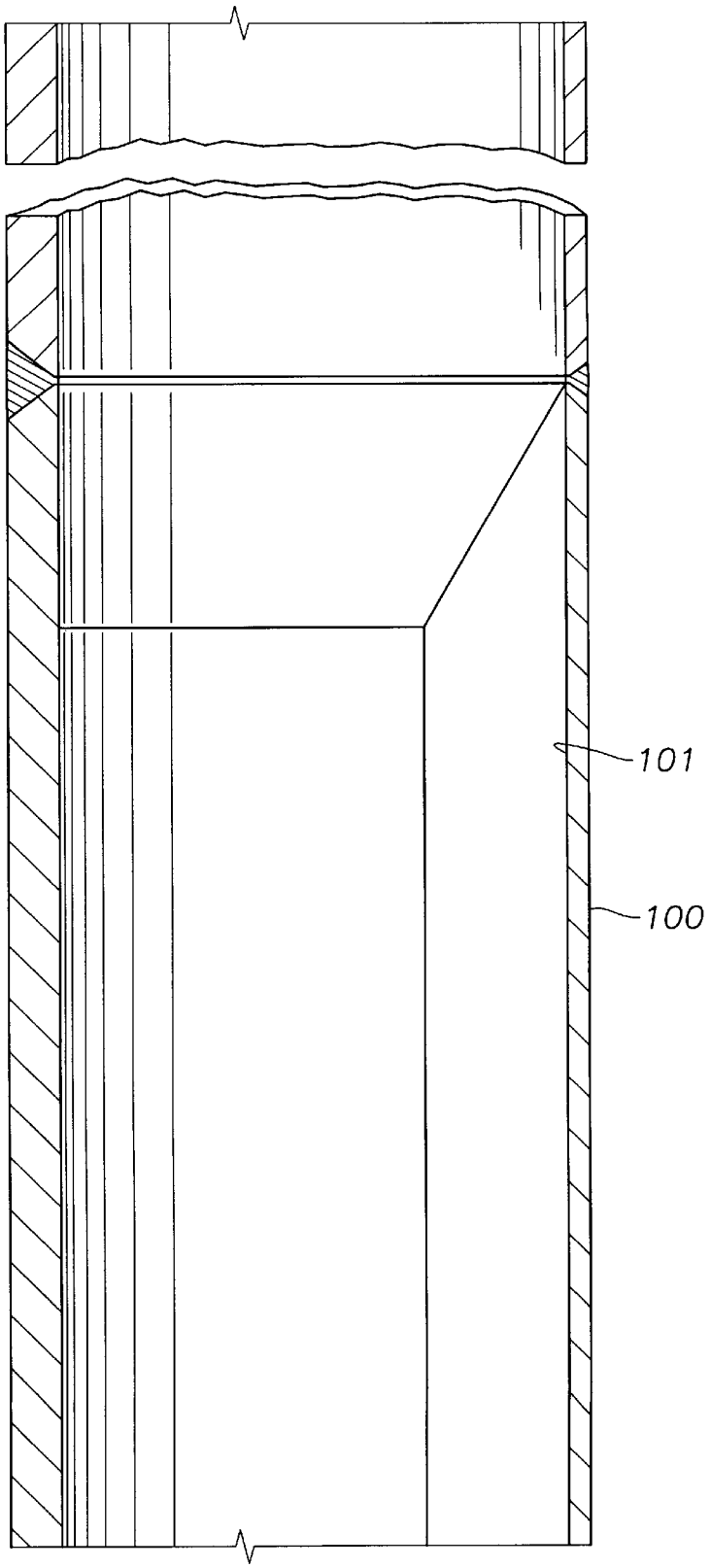
Figure 19C:
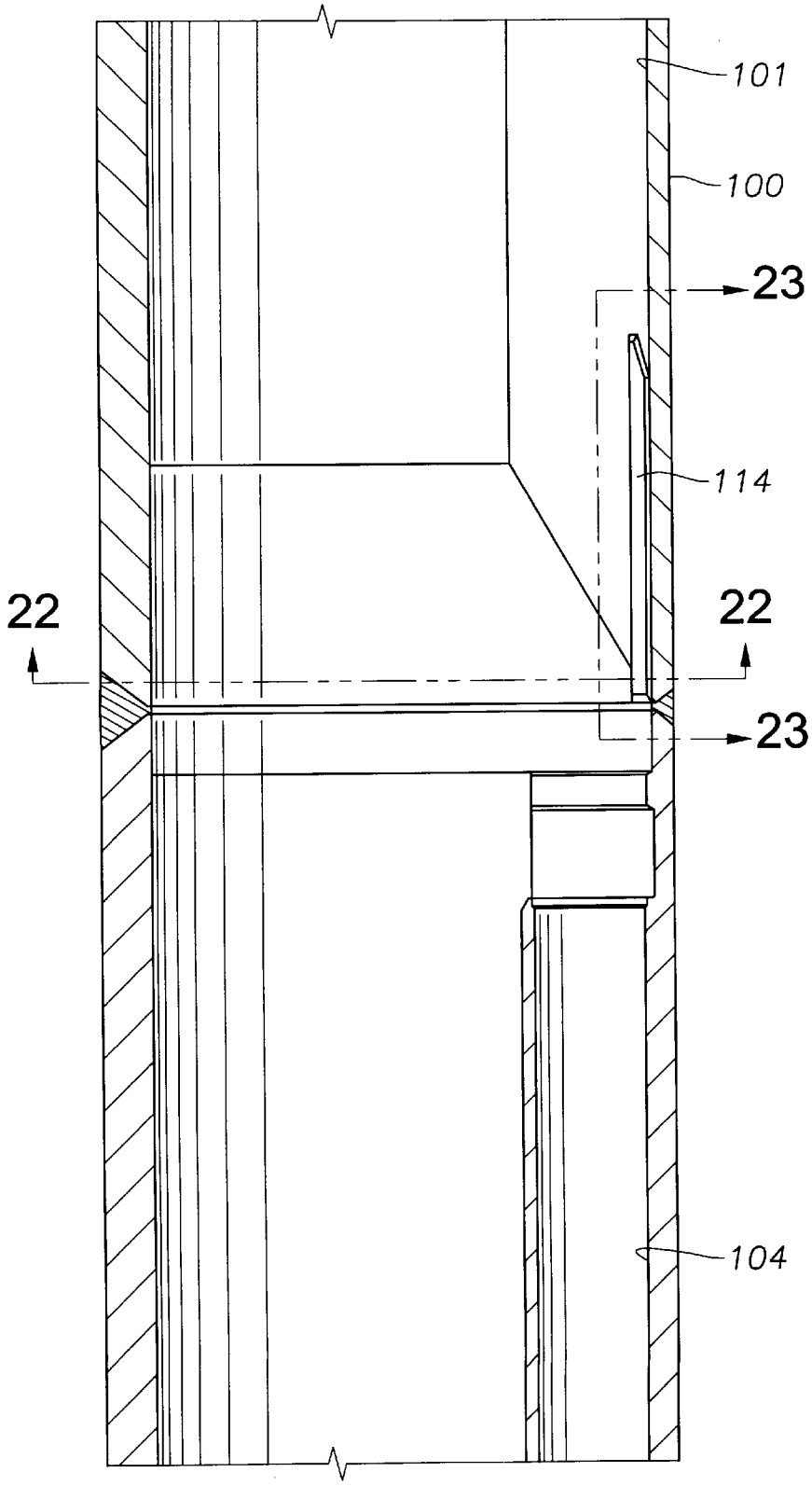
Figure 19D:
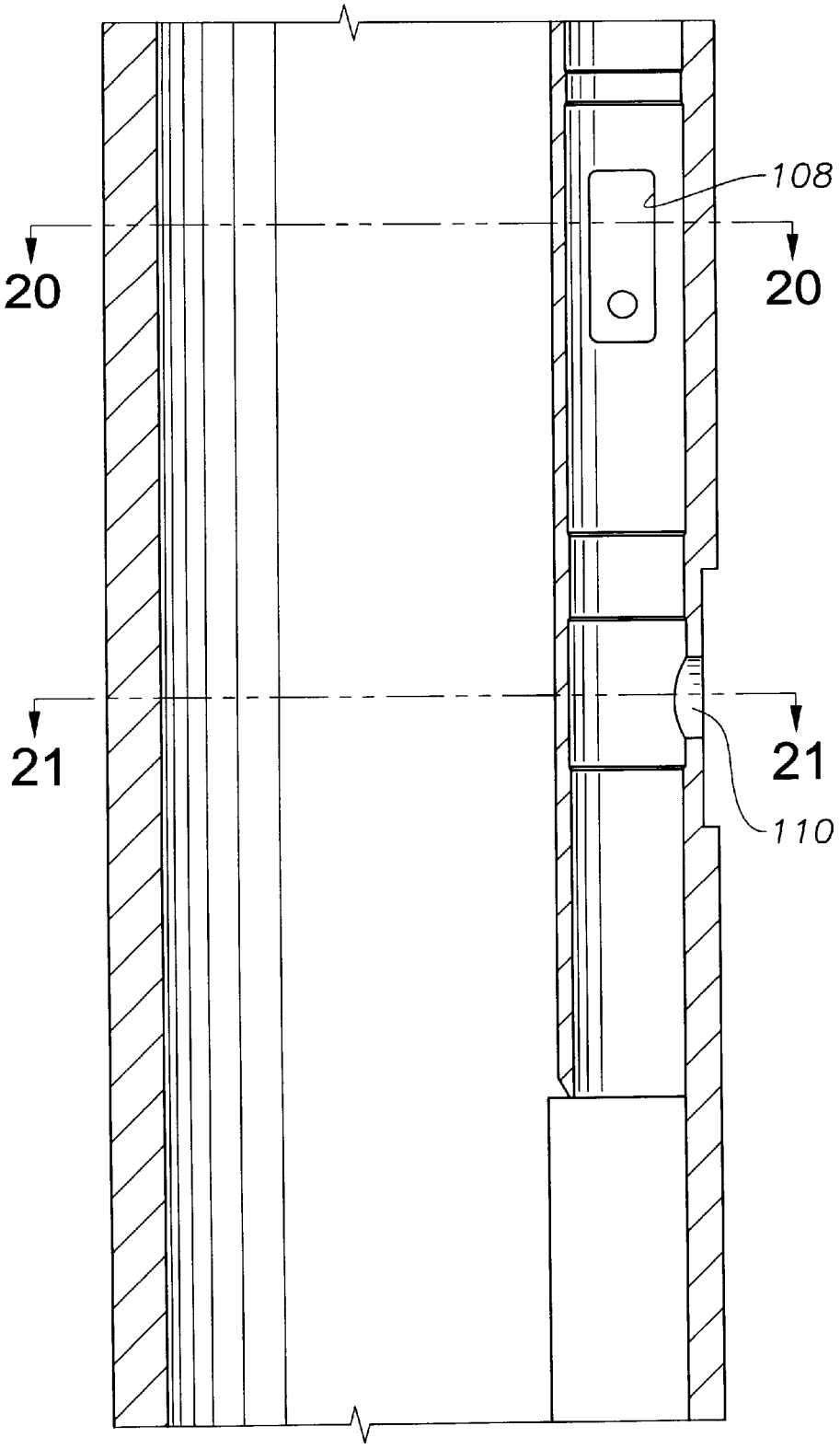
Figure 19E:
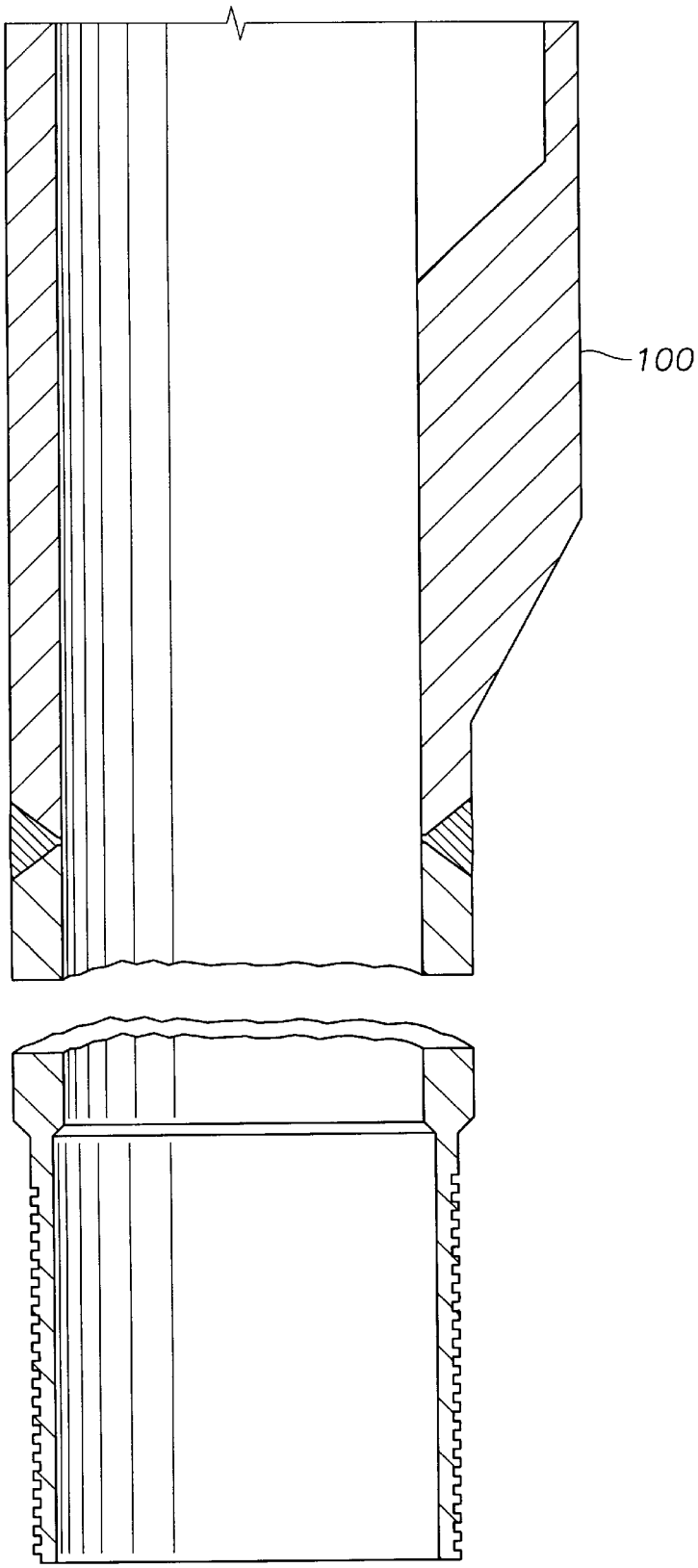
Figure 22:
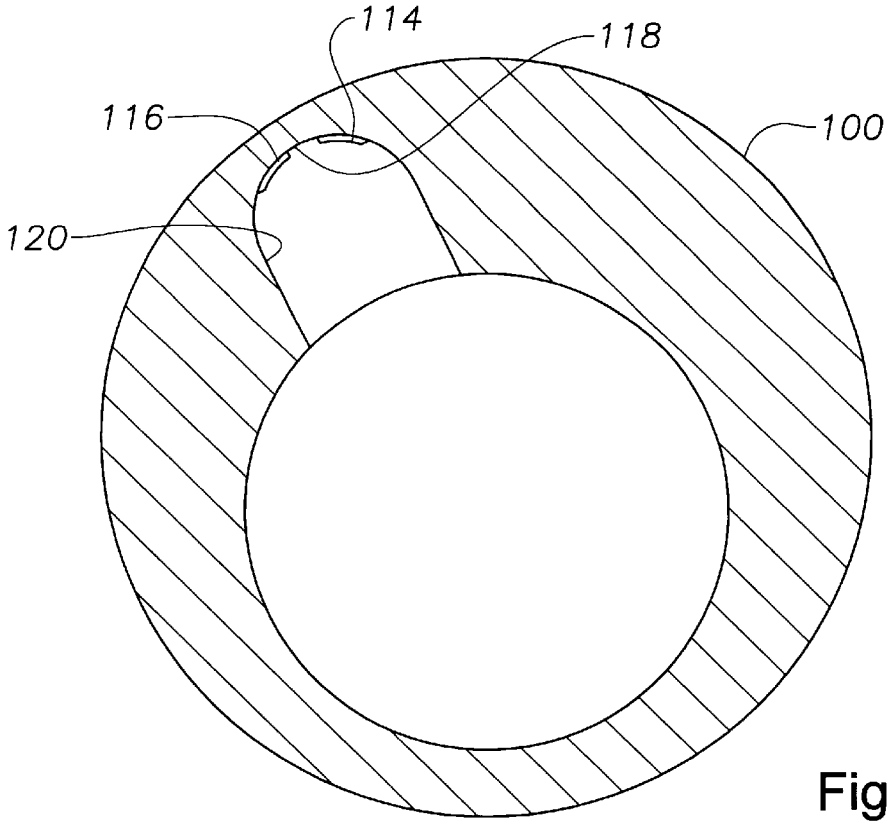
FIG. 22 is a cross-sectional view taken along line 22—22 of FIG. 19C.
Figure 23:
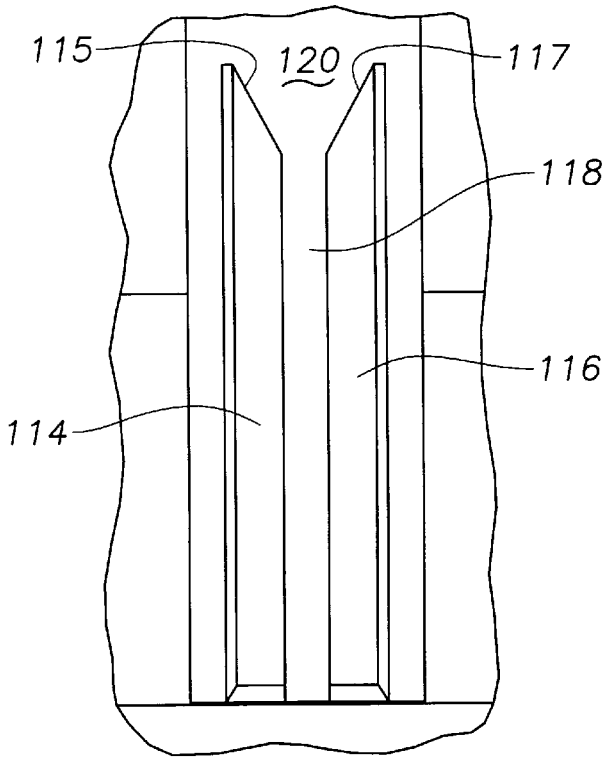
FIG. 23 is a fragmentary elevation view taken along line 23—23 of FIG. 19C.

Reference will now be made to FIGS. 19C, 22 and 23. FIG. 22 is a cross-sectional view taken along line 22—22 of FIG. 19C, and FIG. 23 is a fragmentary elevation view taken along line 23—23 of FIG. 19C. Taken together, FIGS. 19C, 22 and 23 show that the mandrel 100 may further include a first orienting guide rail 114 and a second orienting guide rail 116. The guide rails 114 and 116 are spaced apart in substantially parallel relationship so as to define a longitudinal groove 118 therebetween. The guide rails 114 and 116 may be on an inner surface 101 of the mandrel 100, and may either be formed as integral parts of the mandrel 100 or individually attached to the mandrel 100, as by welding. The guide rails 114 and 116 are located above the first pocket 104 and may be located within a discriminator trough 120 in the mandrel 100. The first guide rail 114 may include a first inclined surface 115 extending away from the longitudinal groove 118 and away from the first pocket 104. Similarly, the second guide rail 116 may include a second inclined surface 117 extending away from the longitudinal groove 118 and away from the first pocket 104. As will be more fully explained below, the function of the guide rails 114 and 116 is to orient at least one reference point on a gas lift valve (not shown here) relative to at least one reference point on the mandrel 100, such as, for example, the window 108 and/or the fluid flow ports 110 and 112.

Figure 24A:
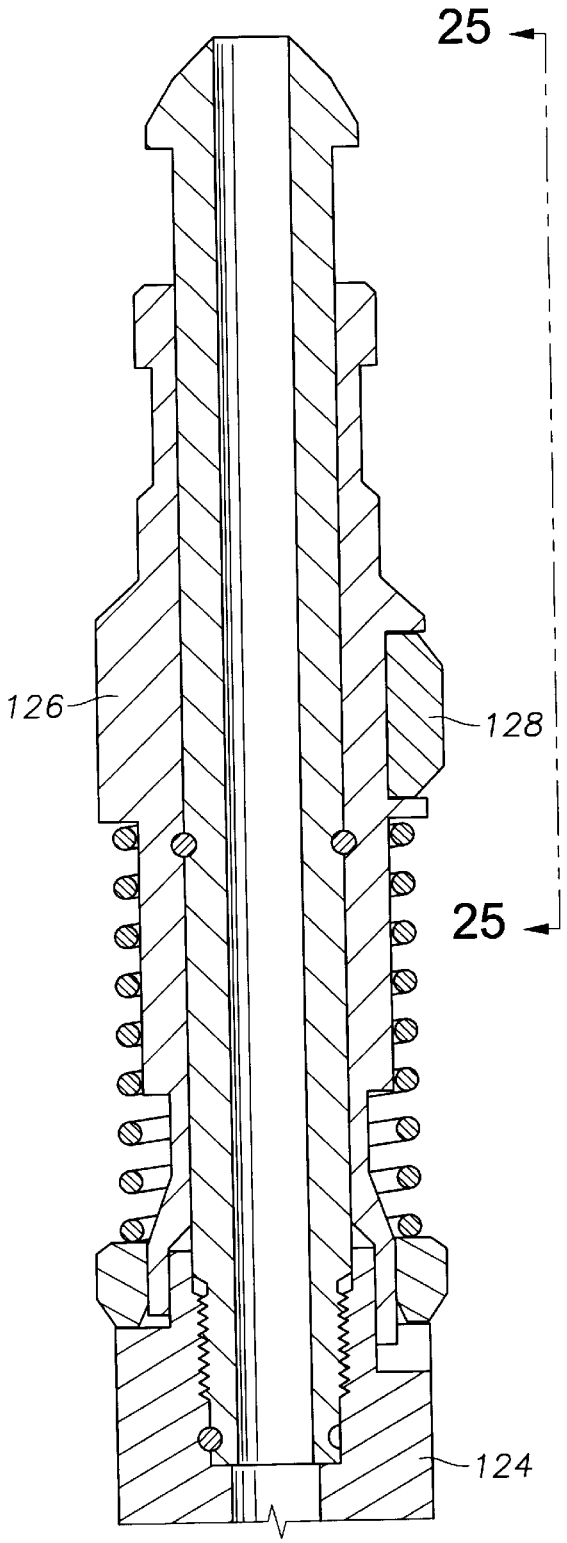
FIGS. 24A–24D are elevation views which together illustrate an alternative embodiment of a gas lift valve of the present invention.
Figure 24B:
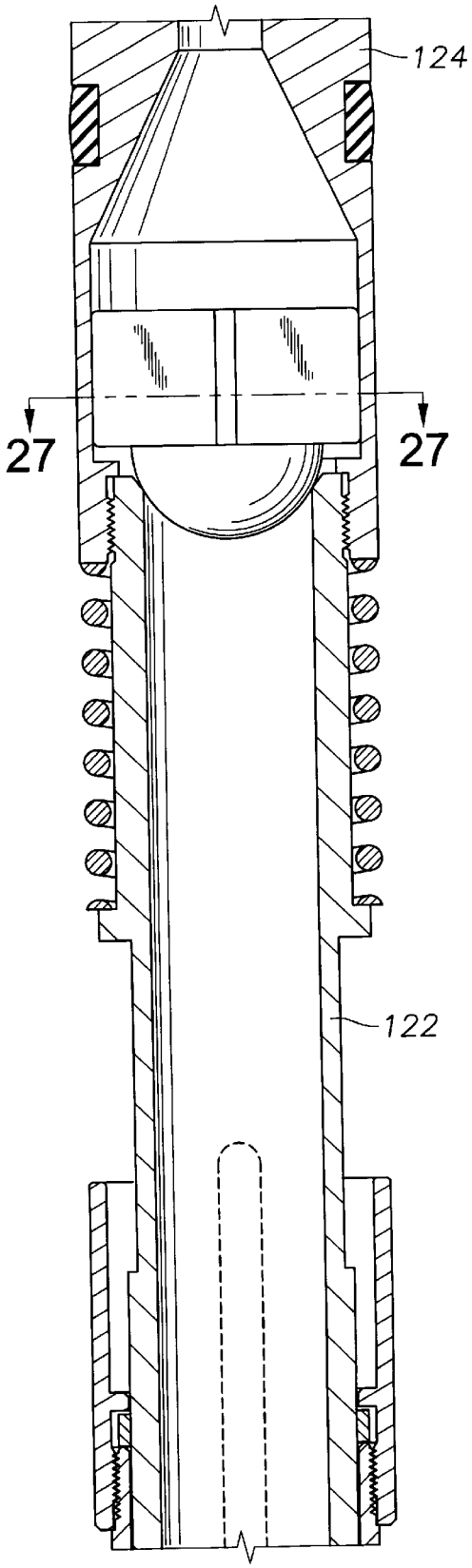
Figure 24C:
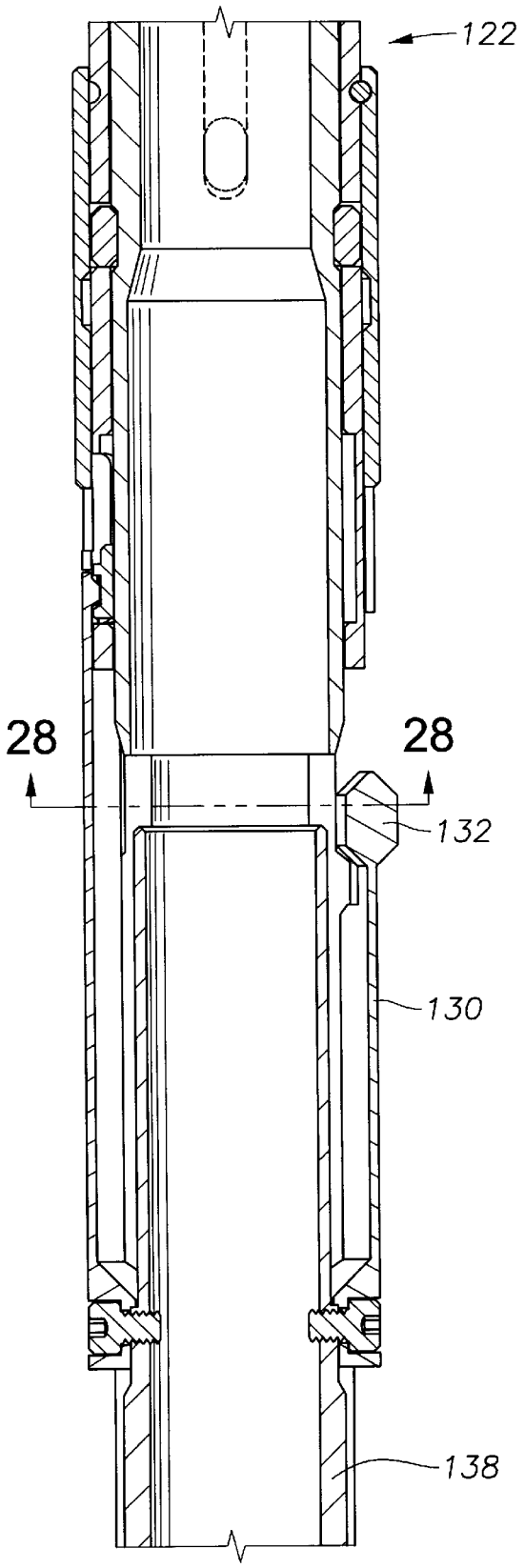
Figure 25:
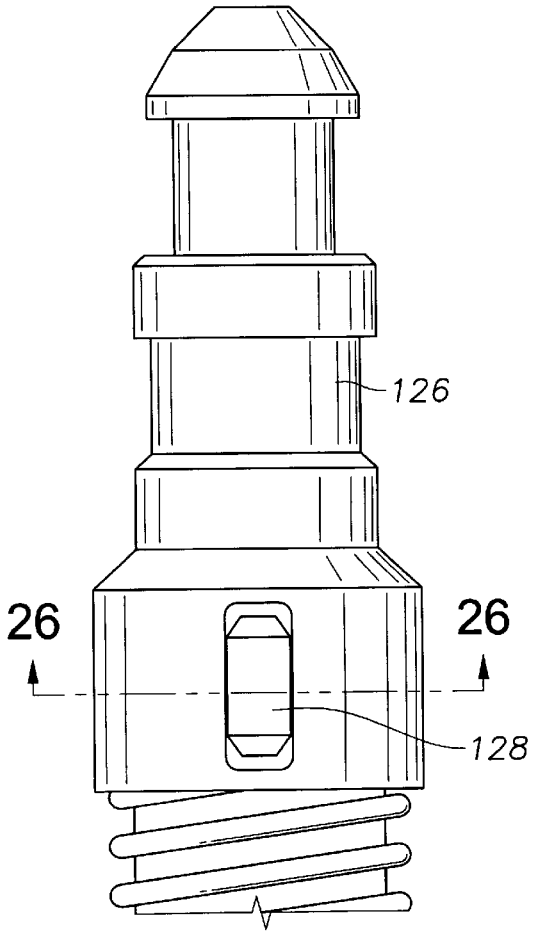
FIG. 25 is a fragmentary elevational view taken along line 25—25 of FIG. 24A.
Figure 27:
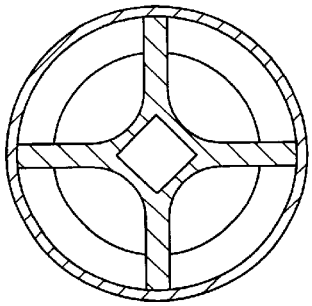
FIG. 27 is a cross-sectional view taken along line 27—27 of FIG. 24B.
Figure 28:
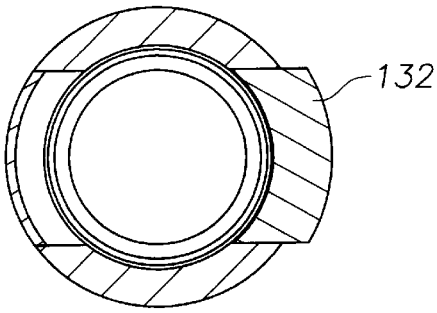
FIG. 28 is a cross-sectional view taken along line 28—28 of FIG. 24C.
Figure 26:
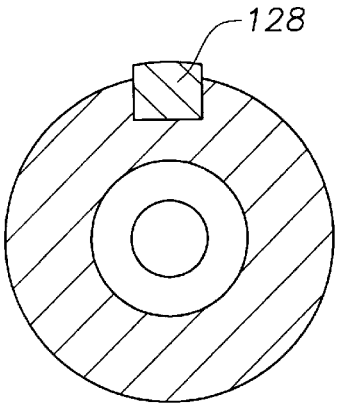
FIG. 26 is a cross-sectional view taken along line 26—26 of FIG. 25.
Figure 29:
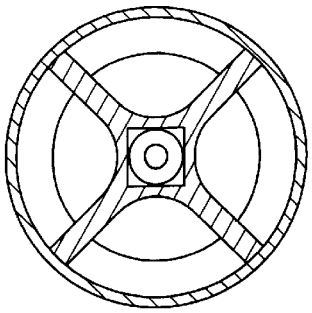
FIG. 29 is a cross-sectional view taken along line 29—29 of FIG. 24D.

A particular embodiment of a gas lift valve for insertion into the first pocket 104 of the above-described mandrel 100 will now be described with reference to FIGS. 24A–24D and 25–29. FIGS. 24A–24D, taken together, show a longitudinal view of a gas lift valve 122, which is similar to the gas lift valve 8 discussed above. A first end 124 of the gas lift valve 122 is shown with a latch 126 attached thereto. The latch 126 is similar to the latch 27 discussed above; one significant difference, however, between the latch 126 and the latch 27 is that the latch 126 includes an orienting key 128, as shown in FIG. 24A. The orienting key 128 is further illustrated in FIGS. 25 and 26. FIG. 25 is a fragmentary elevational view taken along line 25—25 of FIG. 24C. FIG. 26 is a cross-sectional view taken along line 26—26 of FIG. 25. As will be more fully explained below, the orienting key 128 is designed to mate with the longitudinal groove 118 (see FIGS. 22 and 23) between the first and second guide rails 114 and 116 within the mandrel 100 to orient at least one reference point on the gas lift valve 122 relative to at least one reference point on the first pocket 104 in the mandrel 100, such as, for example, the window 108 and/or the fluid flow ports 110 and 112.

As noted above, the gas lift valve 8, discussed above in relation to FIGS. 1–18, and the gas lift valve 122 shown here (in FIGS. 24–29), are very similar; however, there is one significant difference between the two, namely, that the gas lift valve 122 (FIGS. 24–29) includes a single collet finger 130 having a single latching dog 132 (see FIGS. 24C and 28), whereas the gas lift valve 8 (FIGS. 1–18) has an annular collet 11 having a plurality of collet fingers and corresponding latching dogs 11*a* (see, e.g., FIG. 1B and 6). The latching dog 132 may correspond to a first reference point. As shown in FIG. 1B, the function of the latching dogs 11*a* is to establish a mechanical connection between the gas lift valve 8 and the actuating means 20. There are number of embodiments of actuators, or independent power sources, shown in FIGS. 1–18, all of which may be used in connection with the orienting aspect of the present invention; the orienting aspect of the present invention is not intended to be limited to use with any particular actuator. In FIG. 1B, the actuating means 20 is a moveable hydraulic piston 32 having a recess 32*a* for receiving one of the latching dogs 11*a*. The recess may correspond to a second reference point. Each of the various embodiments of actuators includes a recess 32*a* for receiving at least one of the latching dogs 11*a*. In the embodiments shown in FIGS. 1–18, there is no need to orient the latching dogs 11*a* relative to the recess 32*a* in the actuating means 20 since there will be a latching dog 11*a* aligned with the recess 32*a* in the actuating means 20 irrespective of the orientation of the gas lift valve 8; this is because, as noted above, the annular collet 11 includes a plurality of latching dogs 11*a* extending about its circumference. However, as noted above, the gas lift valve 122 shown in FIGS. 24–29 does not include a plurality of collet fingers and latching dogs 11*a* extending about the circumference of the annular collet 11, as shown in FIGS. 1–18, but, instead, as shown in FIGS. 24C and 28, includes only a single collet finger 130 having a single latching dog 132. As such, there is a need to orient the gas lift valve 122 relative to the actuating means so that the single latching dog 132 is aligned with the recess in the actuating means. The recess and actuating means is not shown in FIGS. 19–21. Any of the various actuator embodiments shown in FIGS. 1–18 may be used. Irrespective of which embodiment is used, the actuating means will be housed in the second pocket 106 of the mandrel 100, as discussed above and as best understood with reference to FIGS. 20 and 21. Further, irrespective of which embodiment of the actuator is used, the actuator will be situated within the second pocket 106 so that the actuator recess for receiving the single latching dog 132 on the single collet finger 130 is positioned within the window 108 connecting the first and second pockets 104 and 106.

To longitudinally align the single latching dog 132 with the window 108, and therefore with the recess (not shown) on the actuator (not shown) housed in the second pocket 106, the latching dog 132 should be longitudinally aligned with the orienting key 128 on the latch 126 before the latch 126 and gas lift valve 122 are lowered into the well (not shown). As stated above, the orienting key 128 is designed to mate with the longitudinal groove 118 (see FIGS. 22 and 23) between the first and second guide rails 114 and 116 within the mandrel 100 to orient the gas lift valve 122 as it is being inserted into the first pocket 104 in the mandrel 100 (see FIGS. 19C, 20, and 21). The longitudinal groove 118 between the guide rails 114 and 116 is longitudinally aligned with the window 108. Before the latch 126 and the gas lift valve 122 are lowered into the well (not shown), they are attached to a kickover tool (not shown), in a manner well known to those of ordinary skill in the art, such that, after the kickover tool (not shown) and gas lift valve 122 have been lowered into the well (not shown) and located and oriented within the mandrel 100 by use of the orienting sleeve 102 (see FIG. 19A), the latching dog 132 on the collet finger 130 and the orienting key 128 on the latch 126 will be directed into contact with either the first or second inclined surfaces 115 or 117 on the first or second guide rails 114 or 116, and then into the longitudinal groove 118, or directly into the longitudinal groove 118 without contacting the inclined surfaces 115 or 117. The latching dog 132 will enter and exit the longitudinal groove 118 before the orienting key 128 enters the longitudinal groove 118. Once the latching dog 132 is in the longitudinal groove 118, the latching dog 132 will be longitudinally aligned with the window 108. The gas lift valve 122 will continue to be lowered into the first pocket 104 until the orienting key 128 on the latch 126 enters the longitudinal groove 118 and the gas lift valve 122 locates in its locked, or lowermost, position, in a manner well known to those of skill in the art, such that the latching dog 132 on the single collet finger 130 is positioned within the window 108 and positively engaged with the recess (not shown here) on the actuator (not shown here) that is housed within the second pocket 106. The manner in which the latching dog 132 is securely engaged with the recess (not shown) is well known to those of ordinary skill in the art. Once this connection is established between the latching dog 132 and the actuator recess (not shown), the actuator (not shown) may be used to open and close the gas lift valve 122, as will be more fully discussed below. The distance between the orienting key 128 on the latch 126 and the latching dog 132 is such that the orienting key 128 remains positioned in the longitudinal groove 118 between the guide rails 114 and 116 when the latching dog 132 is secured to the actuator recess (not shown).

In addition to orienting the gas lift valve 122 within the first pocket 104 so as to align the latching dog 132 with the actuator recess (not shown), it may also be desired to orient the gas lift valve 122 for other reasons, such as relative to the first and second fluid flow ports 110 and 112, shown in FIG. 21.

Figure 24D:
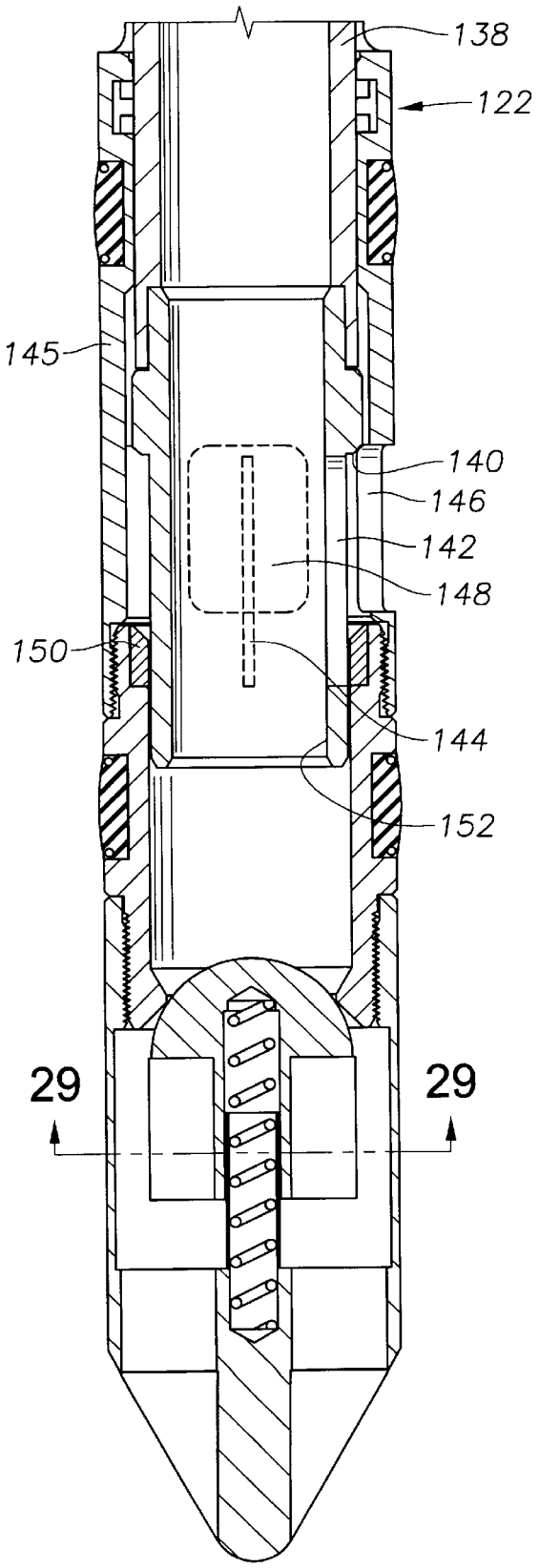

Referring now to FIGS. 24C and 24D, which show the gas lift valve 122 in an open position, the gas lift valve 122 may include a stem 138 connected to the collet finger 130 and having an annular sealing surface 140, a first flow slot 142, and a second flow slot 144, shown with dashed lines. In a specific embodiment, the first flow slot 142 and the second flow slot 144 may be aligned at right, or 90 degree, angles to one another. The gas lift valve 122 may further include a valve body 145 having a first flow window 146, a second flow window 148 (shown with dashed lines), and an annular stem seat 150. In a specific embodiment, the first flow window 146 and the second flow window 148 may be aligned at right, or 90 degree, angles to one another. The stem 138 is disposed for longitudinal movement within the valve body 145. The stem 138 is moved up and down by the collet finger 130, which is moved up and down by the actuator (see, e.g., the actuating means 20 in FIG. 1B), by virtue of the actuator and collet finger 130 being mechanically attached to one another via the latching dog 132 and the recess 32*a* (see FIG. 1B). When the valve 122 is in its open position, as shown in FIG. 24D, the first flow slot 142 on the stem 138 is positioned adjacent the first flow window 146 on the valve body 145, and the second flow slot 144 on the stem 138 is positioned adjacent the second flow window 148 on the valve body 145, so as to establish two channels through which lift gas may flow into the valve 122. When the valve is moved to its closed position (not shown), the stem sealing surface 140 is sealed against the stem seat 150, so as to prohibit the flow of lift gas through the flow windows 146 and 148, and through the flow slots 142 and 144, respectively. The flow windows 146 and 148, and the flow slots 142 and 144, are positioned in a specific relationship to the latching dog 132 so that when the gas lift valve 122 is properly located within the first mandrel pocket 104 (i.e., when the latching dog 132 is engaged with the actuator recess), the first flow window 146 and the first flow slot 142 are longitudinally and elevationally aligned with the first flow port 110 in the mandrel 100 (see FIG. 21), and the second flow window 148 and the second flow slot 144 are longitudinally and elevationally aligned with the second flow port 112 in the mandrel 100 (see FIG. 21).

Figure 30:
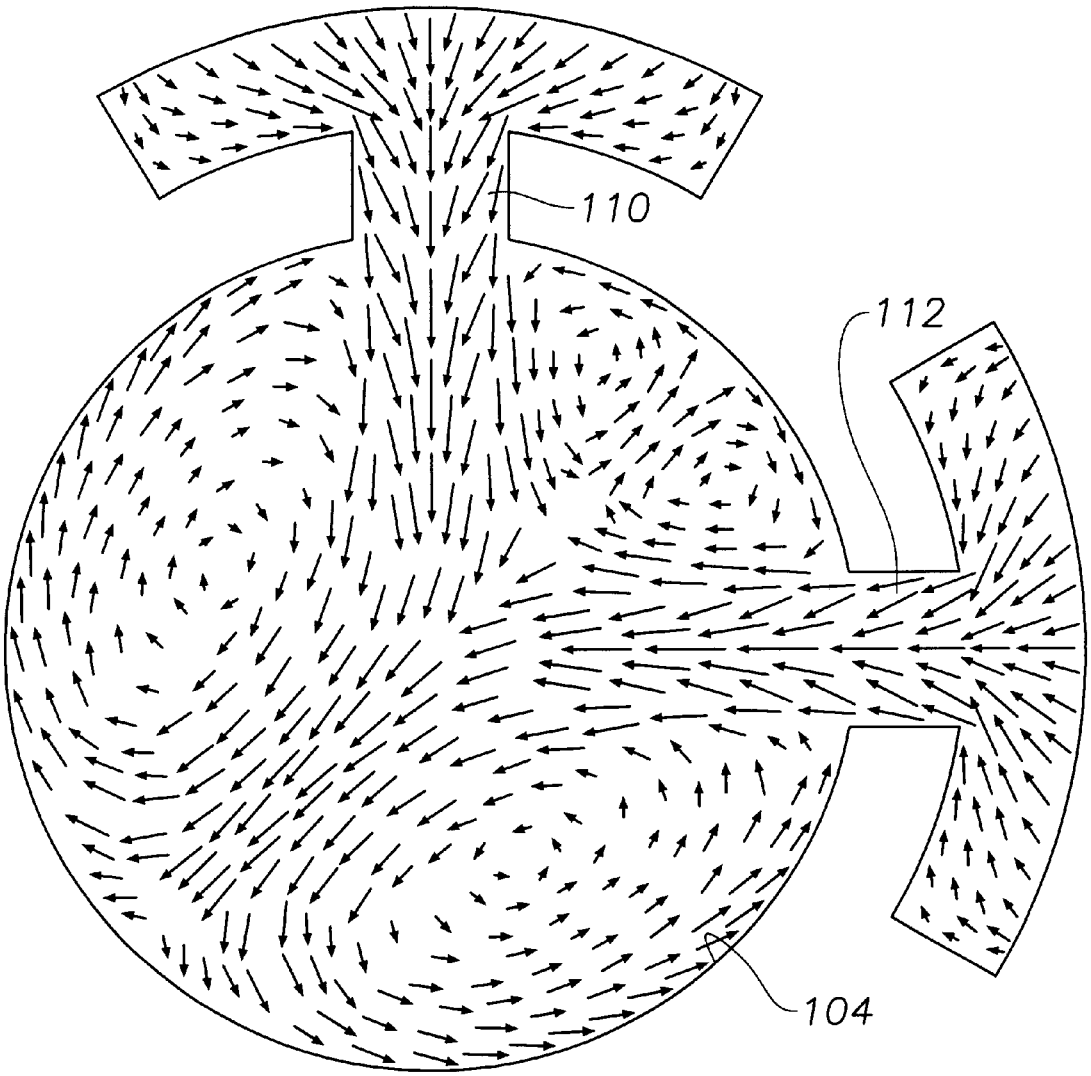
FIG. 30 shows jets of lift gas flowing into mandrel flow ports and colliding with one another and thereby being slowed down and redirected to lessen erosion.

With the gas lift valve 8, discussed above with reference to FIGS. 1–18, there is no need to orient the gas lift valve 8 relative to the injection gas ports 13 (see FIG. 7) because the valve body 10 (see FIG. 1B) associated with the gas lift valve 8 is provided with a plurality of flow slots 10*a* disposed about the circumference of the valve body 10. As such, irrespective of the orientation of the gas lift valve 8 relative to the injection gas ports 13, there will be a flow slot 10*a* disposed adjacent each of the injection gas ports 13 to facilitate the flow of injection gas 18 into the gas lift valve 8. However, with the gas lift valve 122 shown in FIGS. 24 to 29, the valve body 145 and the stem 138 each include just two flow channels, namely the first and second flow windows 146 and 148, and the first and second flow slots 142 and 144. As such, it is desirable to align the first flow window 146 and the first flow slot 142 (see FIG. 24D) with the first flow port 110 on the mandrel 100 (see FIG. 21), and to align the second flow window 148 and the second flow slot 144 with the second flow port 112 on the mandrel 100. A key advantage to providing the gas lift valve 122 with only two flow channels for the lift gas to flow into the valve 122 is that erosion of an inner bore 152 of the stem 138, due to high-velocity gas flow thereover, is reduced. This is especially so when the two flow channels are positioned relative to one another at right, or 90 degree, angles. As illustrated by FIG. 30, this is because the jets of lift gas flowing into the valve 122 through the mandrel flow ports 110 and 112 collide with one another and are thereby slowed down and redirected to prevent high-velocity contact of the jets with the inner bore 152.

Whereas the present invention has been described in particular relation to the drawings attached hereto, it should be understood that other and further modifications, apart from those shown or suggested herein, may be made within the scope and spirit of the present invention. For example, it should be understood that the orienting aspect of the present invention is not limited to orienting a gas lift valve relative to an actuator, but may be used for the relative orientation of any two devices within parallel pockets in a mandrel. Further, the orienting aspect of the present invention may be used not only for the purpose of establishing a mechanical connection between two devices within parallel mandrel pockets, but also to make an indirect (e.g., magnetic, electrical, etc.) connection between two devices within parallel mandrel pockets, even if there is no window connecting the parallel pockets. Accordingly, the invention is therefore to be limited only by the scope of the appended claims.

I claim:

1. An apparatus for orienting a first device in a first pocket in a mandrel relative to a second device in a second pocket in the mandrel, the first and second pockets being substantially parallel to one another, comprising:

a first guide rail and a second guide rail, the first and second guide rails being on an inner surface of the mandrel and spaced apart in substantially parallel relationship to define a longitudinal groove therebetween;

the first device having an orienting key and a first reference point, the orienting key and the first reference point being longitudinally aligned;

the second device having a second reference point; and, the first and second reference points being longitudinally aligned when the orienting key is disposed within the longitudinal groove between the guide rails.

2. The orienting apparatus of claim 1, wherein the longitudinal groove is above the first pocket.

3. The orienting apparatus of claim 1, wherein the first and second guide rails are located within a discriminator trough in the mandrel.

4. The orienting apparatus of claim 1, wherein the first device is a latch attached to a variable orifice gas lift valve.

5. The orienting apparatus of claim 4, wherein the orienting key is attached to the latch.

6. The orienting apparatus of claim 4, wherein the first reference point is a latching dog on a collet finger, the collet finger being attached to a stem disposed for longitudinal movement within a valve body of the gas lift valve, the second reference point being a recess on the second device, the latching dog being securely engaged with the recess when the gas lift valve is in a lowermost position.

7. The orienting apparatus of claim 6, wherein the second device is a means for actuating the gas lift valve.

8. The orienting apparatus of claim 6, wherein the first pocket and the second pocket are connected by a window, and the connection between the latching dog and the recess is made through the window.

9. The orienting apparatus of claim 4, wherein the gas lift valve includes a first and a second flow window, and the mandrel further includes a first and a second flow port, the first flow port being aligned with the first flow window when the first and second reference points are longitudinally and elevationally aligned.

10. The orienting apparatus of claim 9, wherein the first and second flow windows are positioned at right angles to each other, and wherein the first and second flow ports are positioned at right angles to each other.

11. The orienting apparatus of claim 1, wherein the first device includes at least one additional reference point, and the second device includes at least one additional reference point, and the at least one additional reference point on the first device is aligned with the at least one additional reference point on the second device with the first and second reference points are longitudinally and elevationally aligned.

12. The orienting apparatus of claim 1, wherein the distance between the orienting key and the first reference point is such that the orienting key is disposed within the longitudinal groove between the guide rails when the first and second reference points are longitudinally and elevationally aligned.

13. An apparatus for orienting a variable orifice gas lift valve in a first pocket in a mandrel relative to a means for actuating the gas lift valve that is located in a second pocket in the mandrel, the first and second pockets being substantially parallel to one another, comprising:

a first guide rail and a second guide rail, the first and second guide rails being on an inner surface of the mandrel and spaced apart in substantially parallel relationship to define a longitudinal groove therebetween;

the gas lift valve having an orienting key and a latching dog, the orienting key and the latching dog being longitudinally aligned;

the actuating means having a recess for engagably receiving the latching dog; and the latching dog and the actuator recess being longitudinally aligned when the orienting key is disposed within the longitudinal groove between the guide rails.

14. The orienting apparatus of claim 13, wherein the latching dog and the actuator recess are elevationally aligned and securely engaged when the gas lift valve is in a lowermost position.

15. The orienting apparatus of claim 14, wherein the first pocket and the second pocket are connected by a window, and the connection between the latching dog and the recess is made through the window.

16. The orienting apparatus of claim 14, wherein the latching dog is part of a collet finger, the collet finger being attached to a stem disposed for longitudinal movement within a valve body of the gas lift valve, the stem having an annular sealing surface, a first flow slot, and a second flow slot, the valve body having an annular stem seat, a first flow window, and a second flow window, the first and second flow windows and the first and second flow slots being longitudinally aligned, respectively, and being positioned relative to the latching dog so that when the latching dog is engaged with the actuator recess the first flow window and the first flow slot are longitudinally and elevationally aligned with a first flow port in the mandrel and the second flow window and the second flow slot are longitudinally and elevationally aligned with a second flow port in the mandrel.

17. The orienting apparatus of claim 16, wherein the first and second flow windows are positioned at right angles to each other, the first and second flow slots are positioned at right angles to each other, and the first and second flow ports are positioned at right angles to each other.

18. The orienting apparatus of claim 13, wherein the longitudinal groove is above the first pocket.

19. The orienting apparatus of claim 13, wherein the first and second guide rails are located within a discriminator trough in the mandrel.

20. The orienting apparatus of claim 13, wherein the orienting key is attached to a remotely retrievable latch, and the latch is attached to the gas lift valve.

21. The orienting apparatus of claim 13, wherein the distance between the orienting key and the latching dog is such that the orienting key is disposed within the longitudinal groove between the guide rails when the latching dog and actuator recess are longitudinally and elevationally aligned.

22. The orienting apparatus of claim 13, wherein the first guide rail includes a first inclined surface extending away from the longitudinal groove and away from the first pocket, and the second guide rail further includes a second inclined surface extending away from the longitudinal groove and away from the first pocket.

23. The orienting apparatus of claim 13, wherein the actuating means is electro-hydraulically operated, further including:

a hydraulic pump located in a downhole housing;

an electric motor connected to and driving the hydraulic pump upon receipt of a signal from a control panel;

hydraulic circuitry connected to and responding to the action of the pump; and, a moveable hydraulic piston responding to the hydraulic circuitry and operatively connected to the variable orifice valve, controlling movement thereof.

24. The orienting apparatus of claim 13, wherein the actuating means is hydraulically operated, further including:

a hydraulic actuating piston located in a downhole housing and operatively connected to the variable orifice valve;

a spring, biasing the variable orifice valve in a full closed position; and, at least one control line connected to the hydraulic actuating piston and extending to a hydraulic pressure source.

25. The orienting apparatus of claim 13, wherein the actuating means is electro-hydraulic further including:

at least one electrically piloted hydraulic solenoid valve located in a downhole housing;

at least one hydraulic control line connected to the solenoid valve and extending to a hydraulic pressure source;

hydraulic circuity connected to and responding to the action of the solenoid valve; and, a moveable hydraulic piston responding to the hydraulic circuitry and operatively connected to the variable orifice valve, controlling movement thereof.

26. The orienting apparatus of claim 13, wherein the actuating means is pneumo-hydraulically actuated, further comprising:

a moveable hydraulic piston having a first and second end, operatively connected to the variable orifice valve, controlling movement thereof;

at least one hydraulic control line connected to a hydraulic pressure source and communicating with the first end of the hydraulic piston; and, a gas chamber connected to and communicating with the second end of the hydraulic piston.

* * * * *